US007317425B2

(12) United States Patent
Tanaka et al.

(10) Patent No.: US 7,317,425 B2
(45) Date of Patent: Jan. 8, 2008

(54) ANTENNA DEVICE AND A METHOD OF MAKING THE ANTENNA

(75) Inventors: Shinichi Tanaka, Tsurugashima (JP); Yuji Doi, Hachioji (JP); Takanobu Kanezashi, Hachioji (JP); Koji Namiki, Higashimurayama (JP); Junrou Yano, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 11/390,807

(22) Filed: Mar. 28, 2006

(65) Prior Publication Data

US 2006/0220957 A1 Oct. 5, 2006

(30) Foreign Application Priority Data

Mar. 31, 2005 (JP) ..... 2005-101656
Mar. 31, 2005 (JP) ..... 2005-101657

(51) Int. Cl.
*H01Q 1/12* (2006.01)
*H01Q 7/00* (2006.01)
*H01Q 1/36* (2006.01)

(52) U.S. Cl. ..... 343/718; 343/870; 343/895

(58) Field of Classification Search ..... 343/718, 343/702, 870, 873, 895
See application file for complete search history.

(56) References Cited

U.S. PATENT DOCUMENTS 5,963,181 A * 10/1999 Abe ..... 343/895
6,657,922 B2 12/2003 Sato
6,765,846 B2 * 7/2004 Saitou et al. ..... 368/10
7,167,134 B2 * 1/2007 Minami et al. ..... 343/718

FOREIGN PATENT DOCUMENTS

JP 2002-98780 A 4/2002

* cited by examiner

*Primary Examiner*—Shih-Chao Chen
(74) *Attorney, Agent, or Firm*—Frishauf, Holtz, Goodman & Chick, P.C.

(57) ABSTRACT

An antenna device comprising a hollow dielectric plastic holder (17) with a pair of opposite ends. A first helical electrode plate (18) is attached to one of the pair of opposite ends and has a first terminal device (25). A second flat electrode plate (19) is attached to the other of the pair of opposite ends and has a second terminal device (28).

5 Claims, 20 Drawing Sheets

ANTENNA DEVICE AND A METHOD OF MAKING THE ANTENNA

BACKGROUND OF THE INVENTION

1. Technical Field

The present invention relates antenna devices and more particularly such devices for use with portable electronic devices such as electronic wristwatches and a method of making the antenna devices.

2. Background Art

Some electronic wristwatches include a radio wave timepiece with a built-in antenna. Japanese patent publication 2002-98780 discloses a wristwatch that includes an antenna device disposed in an antenna reception space near and within a plastic case on a straight line connecting the center of the wristwatch and a band attachment provided on the outer periphery of the case. The antenna device comprises a bar antenna around which a coil is formed.

In this antenna device, the bar antenna around which the coil is formed is effective to receive radio waves of a long wavelength, but ineffective to receive radio waves of a short wavelength or a high frequency. Thus, the antenna device is not suitable for a GPS antenna that receives radio waves of a short wavelength from artificial satellites to specify the user's location. Furthermore, the antenna device requires forming a coil around the core, which is troublesome, expensive and makes the resulting antenna device weighty.

It is an object of the present invention to provide an antenna device that is easy to make, light in weight, and capable of receiving radio waves of a short wavelength with high sensitivity, and a method of making the antenna device.

Another object is to provide an antenna device that is easy to attach and connect and capable of receiving radio waves of a predetermined wavelength with high sensitivity.

SUMMARY OF THE INVENTION

In order to achieve the above objects, the present invention provides an antenna device comprising a hollow dielectric plastic holder with a pair of opposite ends with the hollow inside of the holder open to the air through the pair of ends. A first helical electrode plate with a first terminal device is attached to one of the pair of opposite ends. A second flat electrode plate with a second terminal device is attached to the other of the pair of opposite ends.

According to this invention, since the holder is hollow, its space between the first and second electrode plates is filled with air of a minimum dielectric constant, thereby allowing radio waves of a predetermined (for example, short) wavelength to be received with high sensitivity.

In another aspect, the present invention provides a method of making an antenna device comprising the steps of forming a first helical electrode plate with a first terminal device, disposing the first electrode plate with the first terminal device at a predetermined position in a mold, injecting dielectric plastic into the mold, thereby forming a hollow holder integral with the first electrode, taking out the hollow holder integral with the first electrode from the mold, and fixing a second electrode plate with a second terminal device to the taken out holder so as to be opposite to the first electrode plate.

According to this invention, the antenna device is easy to make, improved in productivity and capable of receiving radio waves of a predetermined wavelength with high sensitivity compared to antenna devices with a coil around which a coil is formed.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE INVENTION

Figure 1:
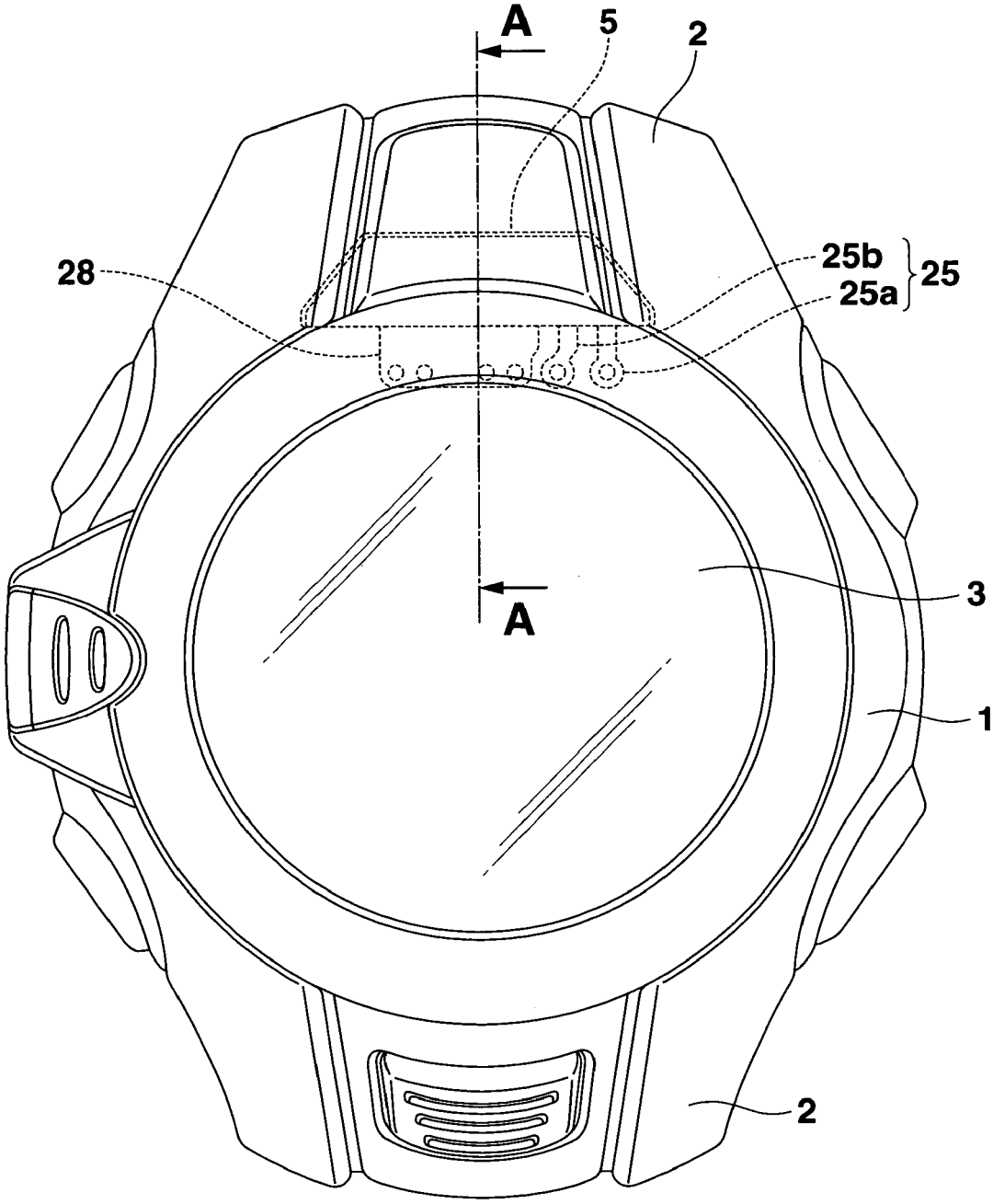
FIG. 1 is an enlarged front view of an electronic wristwatch to which an embodiment 1 of an antenna device according to the present invention is applied.

Several embodiments of an antenna according to the present invention applied to an electronic wristwatch will be described with reference to figures of the drawing in which like reference numerals are used to denote like or similar items or parts.

Embodiment 1

Figure 2:
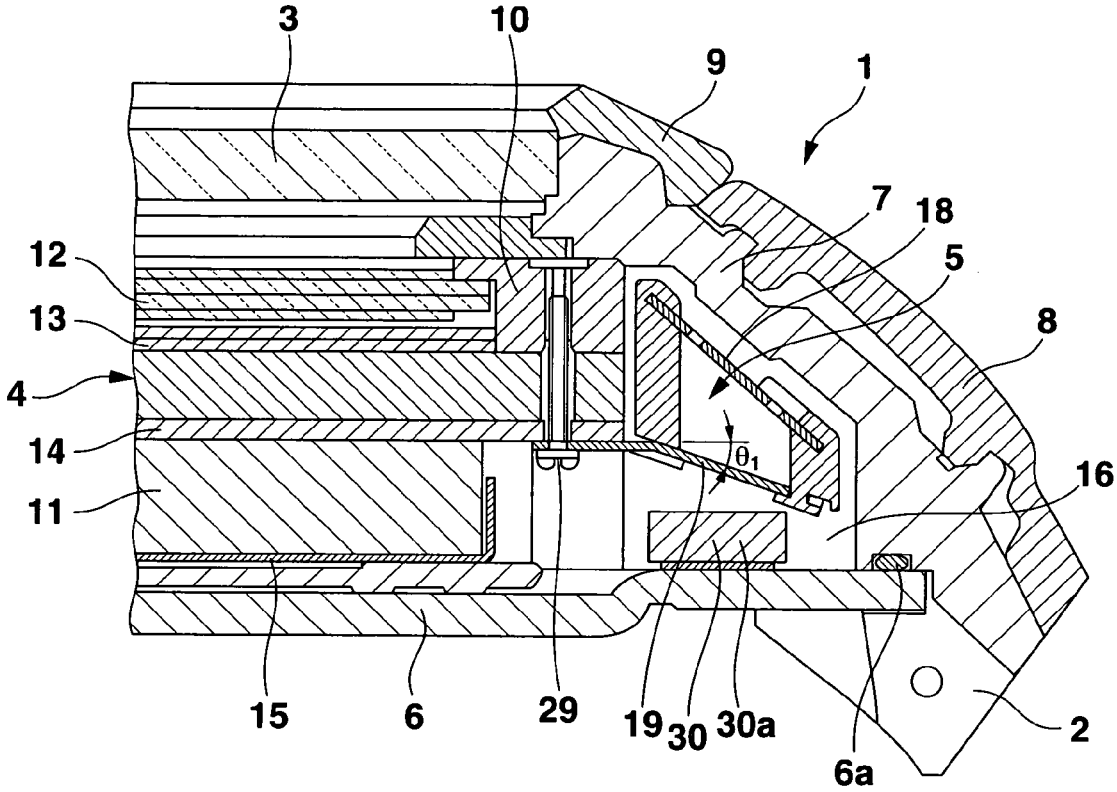
FIG. 2 is an enlarged cross-sectional view taken along a line II-II in FIG. 1.
Figure 3:
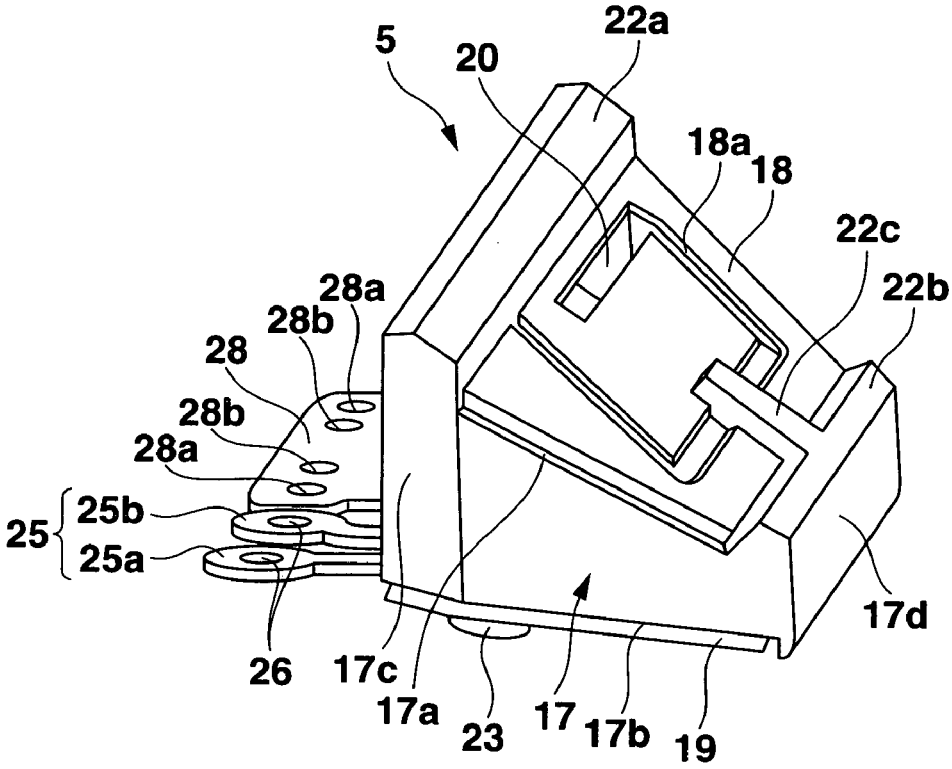
FIG. 3 is an enlarged perspective view of the antenna device of FIG. 2.

Referring to FIGS. 1-18, an embodiment 1 of the antenna device will be described. FIG. 1 is an enlarged front view of an electronic wristwatch to which the present invention is applied. FIG. 2 is a fragmentary enlarged cross-sectional view of the wristwatch taken along a line A-A in FIG. 2. FIG. 3 is an enlarged perspective view of the antenna apparatus of FIG. 2.

The wristwatch has a plastic case 1 as shown in FIGS. 1 and 2. The case has a pair of band attachments 2 each provided at a respective one of positions on the outer periphery of the case 1 at 6 and 12 o'clock. As shown in FIG. 2, a crystal 3 is attached to the top of the case 1. A timepiece module 4 and a GPS (Global Positioning System) antenna device 5 are received at 16 the case 1 with a back cover 6 attached through a waterproof ring 6*a* to the bottom of the case.

As shown in FIG. 2, the case 1 comprises a main rigid case part 7, for example, of ABS, a first soft bezel 8, for example, of urethane resin fitting over a middle portion of the case part 7, and a second ornamental bezel 9 fitting over an upper portion of the case part 7. The timepiece module 4 comprises various electronic components necessary for performing timepiece and GPS functions such as display time information and GPS information based on received radio wave information.

As shown in FIG. 2, the timepiece module 4 comprises an upper housing 10 and a lower housing 11. A display panel 12 and a back light panel 13 are provided within the upper housing 10. A circuit board 14 is disposed between the upper and lower housings 10 and 11. A base plate 15 is disposed on the lower surface of the lower housing 11 and combines the upper and lower housings 10 and 11 and the circuit board 14 together. These components are disposed together within the case 1.

As shown in FIG. 2, the antenna device 5 is attached to the circuit board 14 in an antenna reception space 16 near and within the case 1 on a straight line connecting the center of the case 1 and the band attachment 2 at 12 o'clock. As shown in FIG. 3-9, the antenna device 5 is in of a small size and comprises a holder 17 made of a dielectric plastic such as ABC and taking the form of a trapezoid (as viewed from above), a first upper electrode 18 provided on an upper inclined end 17*a* of the holder 17 and a second electrode 19 provided opposite the first electrode 18 on a lower somewhat horizontal end 17*b* of the holder 17.

Figure 6A:
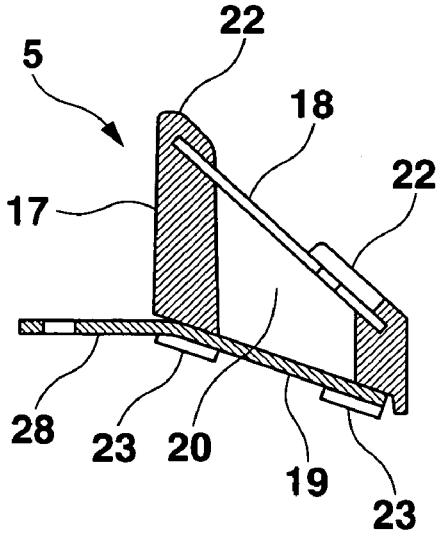
FIGS. 6A and 6B are cross-sectional views taken along lines V-V and VI-VI, respectively, of FIG. 5.
Figure 6B:
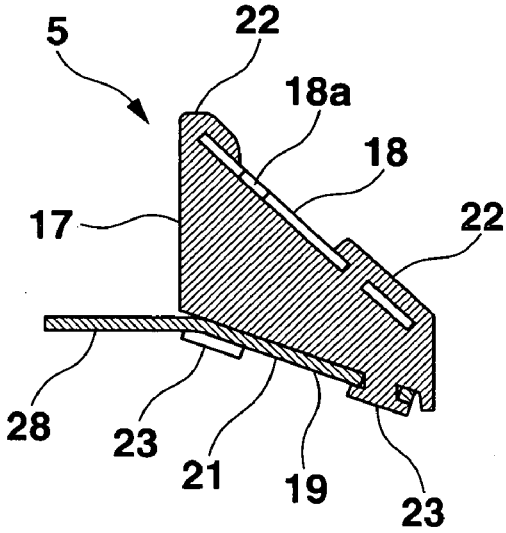
Figure 7A:
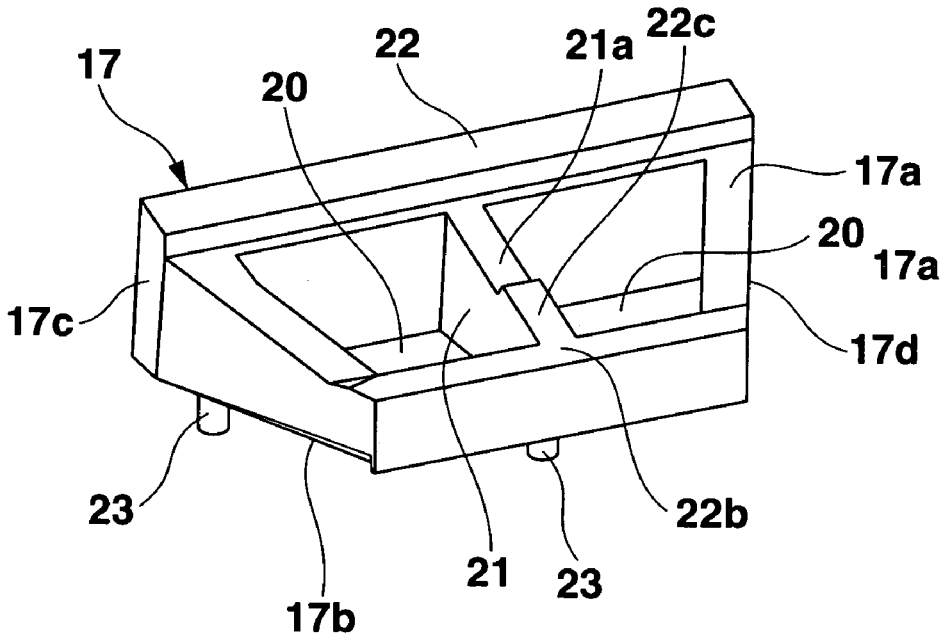
FIGS. 7A and 7B are perspective views of a holder of the antenna device of FIG. 3 as viewed from above and below, respectively.
Figure 7B:
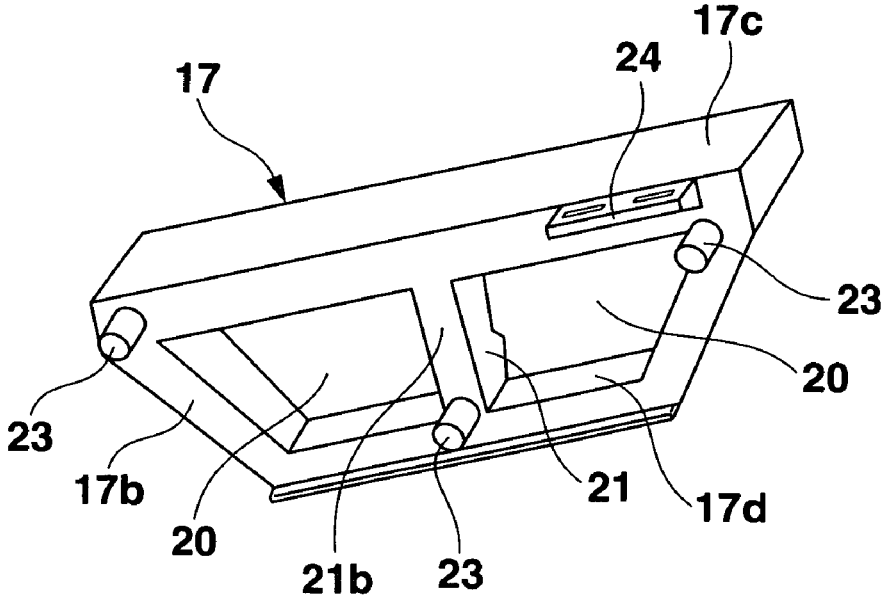

As shown in FIGS. 6, 7A and 7B, a support wall 21 connecting higher and lower walls 17*c* and 17*d* of the holder 17 involving the longer and shorter sides, respectively, of the trapezoid is provided at the center of the inner space or cavity 20 within the holder 17 so as to extend across its inner space or cavity 20 such that the support wall 21 supports the first and second electrodes 18 and 19 from below and above, respectively, thereby maintaining these electrodes even. The antenna device 5 is disposed within the case 1 in such a manner that the higher and lower walls 17*c* and 17*d* of the holder 17 are closer to the center and inner periphery, respectively, of the case 1.

Figure 4:
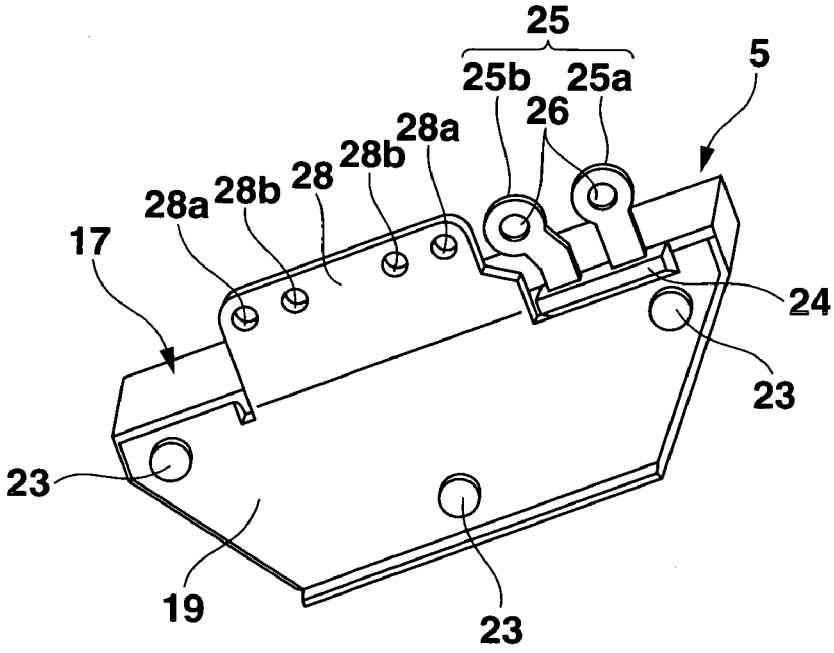
FIG. 4 is an enlarged perspective view of the antenna device 1 of FIG. 3 as viewed from blow.

As shown in FIGS. 3 and 7A, vertical protective protrusions 22*a* and 22*b* are provided forming upper portions of the higher (or rear) and lower (or front) walls 17*c* and 17*d* of the holder 17. The protrusion 22*b* has a branch 22*c* extending perpendicular thereto from a midpoint thereof obliquely upward along the surface of the first electrode 18, thereby protecting the first electrode 18. As shown in FIG. 7B, three fusible bosses 23 are provided at predetermined positions on the lower end 17*b* of the holder 17; that is, two each on substantially a respective one of opposite ends of the longer side of the trapezoidal bottom of the holder 17, and one on a midpoint of the shorter side such that the second electrode 19 can be fixed by fusion to the holder 17. A terminal attachment 24 is provided at a right end of the longer side of the trapezoidal bottom of the holder 17, as shown in FIGS. 4 and 7B.

Figure 5:
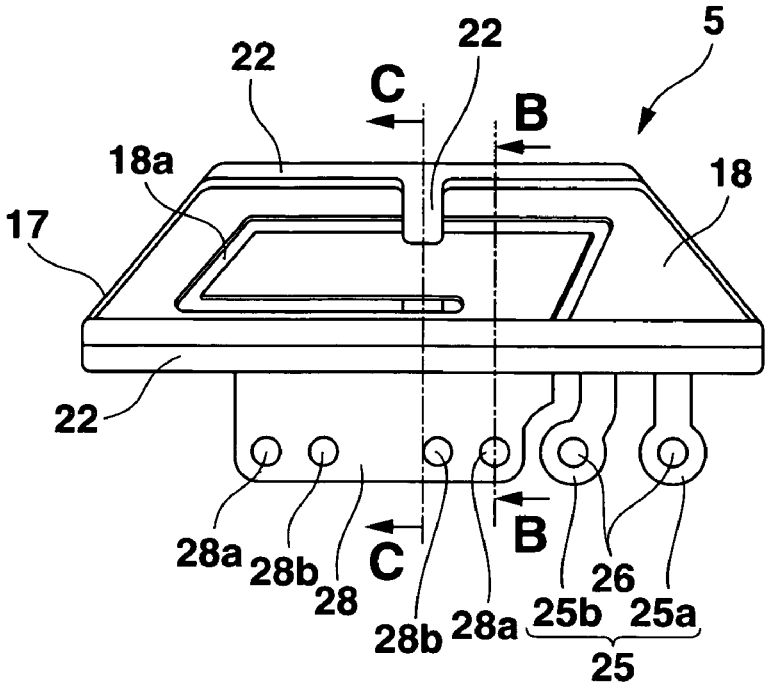
FIG. 5 is an enlarged plan view of the antenna device of FIG. 3.
Figure 8:
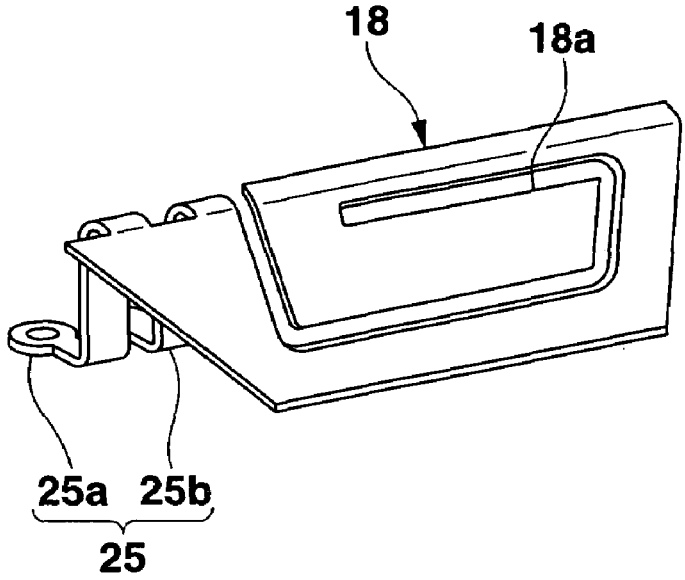
FIG. 8 is a perspective view of a first electrode of FIG. 3.

The first electrode 18 comprises a flat helical antenna (defined by a helical slit 18*a*) of a conductive (for example, copper) foil approximately 0.2 mm thick having substantially a trapezoidal area substantially covering the upper end 17*a* of the holder 17, as shown in FIGS. 3, 5 and 8. The antenna 18 is held at its opposite edges by the corresponding edges of the holder 17 in an embedded manner as shown in FIGS. 3, 5 and 6. As shown in FIG. 8, a first terminal device 25 is formed integral with a rear left end of the first electrode 18.

The first terminal device 25 comprises an antenna terminal 25*a* and a ground terminal 25*b*. As shown in FIGS. 3, 4 and 5, these terminals 25*a* and 25*b* extend down through the higher (or real) wall 17*c* of the holder 17 to the terminal attachment 24 provided at the lower end of the holder 17. The terminals 25*a* and 25*b* have a slot 26.

The second electrode 19 is a ground one made of a conductive (for example, copper) foil approximately 0.2 mm thick and has substantially trapezoidal area substantially covering the lower end of the holder 17. The second electrode 19 has therein a plurality of holes 27 that will receive a like number of fusible bosses 23 provided on the lower end of the holder 17 for fixing purposes.

Figure 9:
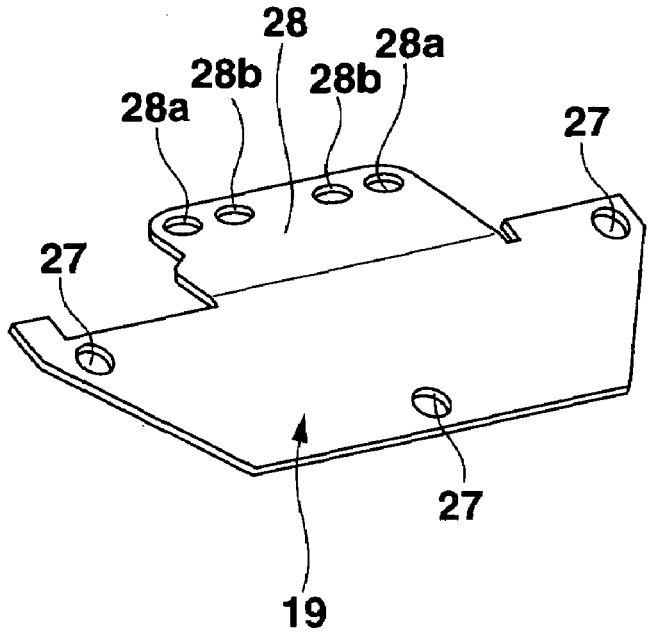
FIG. 9 is a perspective view of a second electrode of FIG. 4.
Figure 10:
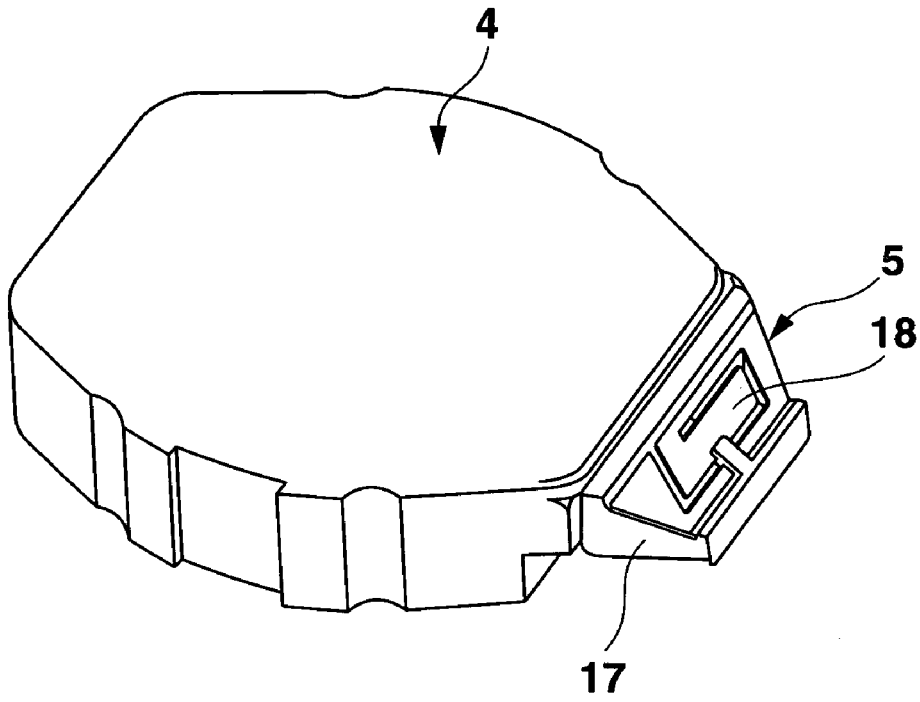
FIG. 10 is a perspective view of a timepiece module to which the antenna device of FIG. 3 is attached.

As shown in FIGS. 4 and 9, the second electrode 19 and has a second terminal device of a rectangular terminal plate 28 extending leftward from a middle part of the longer (or rear) side of the second trapezoidal electrode 19. The second terminal device 28 is a ground one and has a plurality of holes 28*a* and 28*b* for screws and fusible bosses, respectively. As shown in best FIG. 4, the first and second terminal devices 25 and 28 of the first and second electrodes 18 and 19, respectively, are arranged side by side so as to protrude backward (or leftward in FIG. 3) at the lower edge of the higher wall 17*c* of the holder 17.

Figure 11:
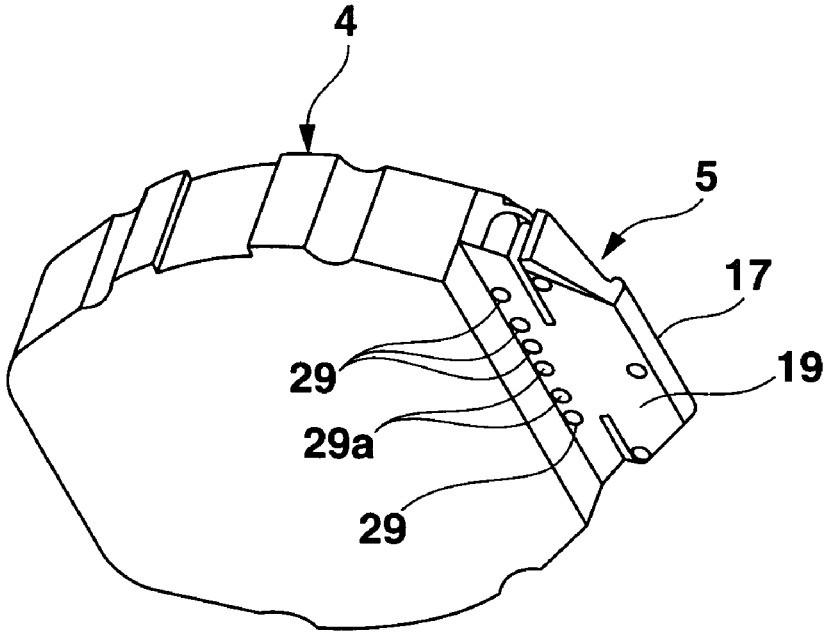
FIG. 11 is a perspective view of the combined antenna device and timepiece module of FIG. 10 as viewed from below.
Figure 12:
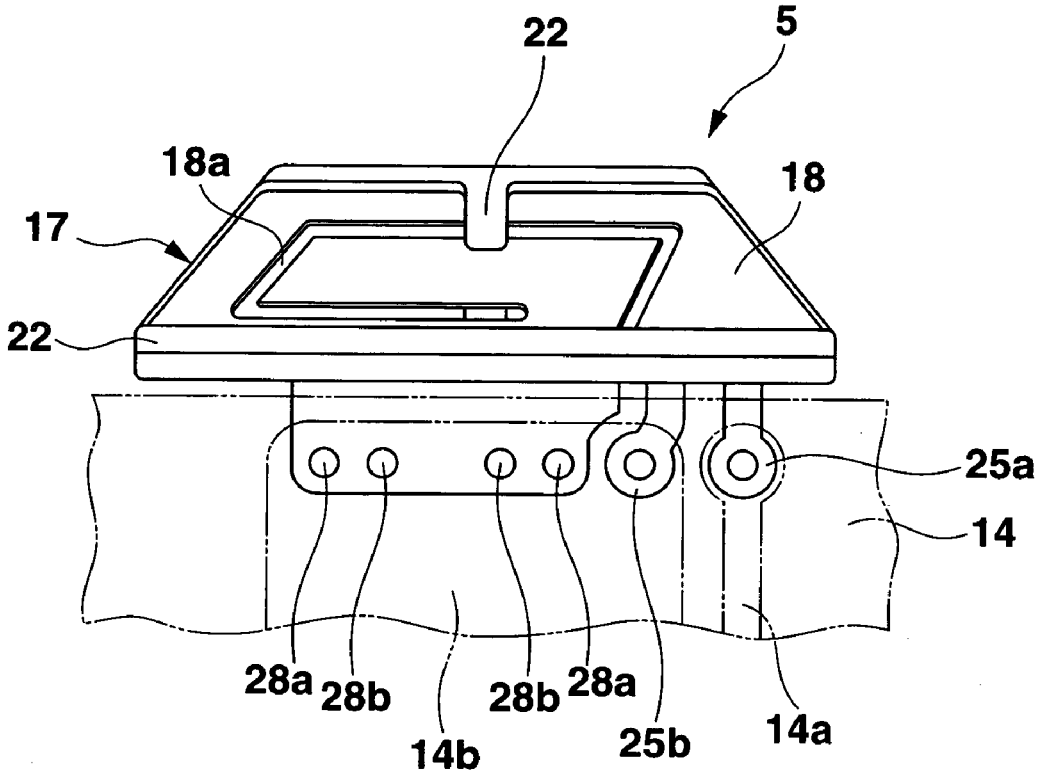
FIG. 12 is an enlarged plan view of the antenna device of FIG. 10 connected to a circuit board.

As shown in FIG. 2, the first and second terminal devices 25 and 28 of the antenna device 5 are bent at a predetermined angle of θ1 to the horizontal, fixed to the circuit board 14 and connected electrically to the terminals 14*a* and 14*b*, respectively, of the circuit board 14. More particularly, as shown in FIGS. 11 and 12, the antenna and ground terminals 25*a* and 25*b* of the first terminal device 25 are fixed by screws 29 to the terminals 14*a* and 14*b*, respectively, of the circuit board 14. The second terminal device 28 is attached to the circuit board 14 by inserting bosses 29*a* of the circuit board 14 into the corresponding holes 28*b* in the second terminal device 28 and then attaching the second terminal device 28 to the terminal 14*b* of the circuit board 14 by the screws 29 inserted in the holes 28*a* in the second terminal device 28.

Figure 13:
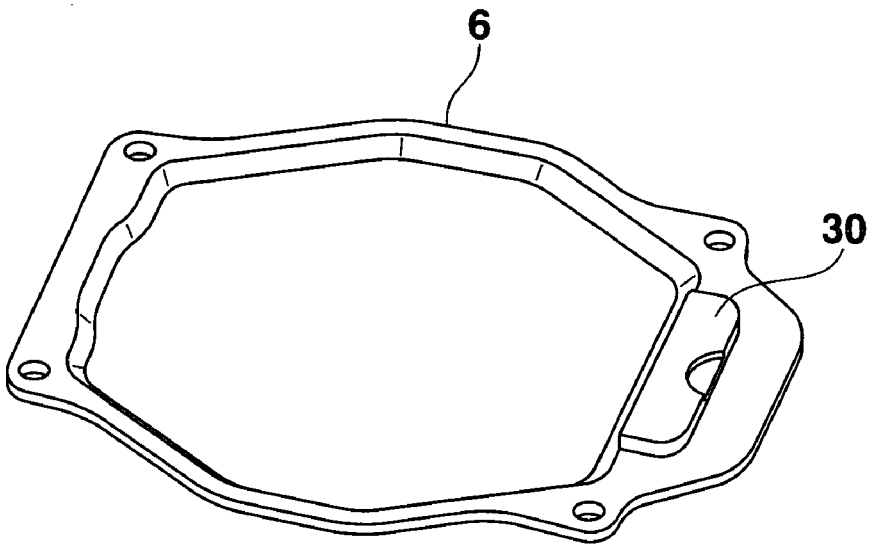
FIG. 13 is a perspective view of a back cover of FIG. 2.

As shown in FIGS. 2 and 13, a stop 38 is attached near the antenna device 5 by an adhesive 30*a* to an upper surface of the back cover 6 positioned below the antenna device 5. The stop 30 is made of a buffer material and prevents the antenna device 5 from deviating excessively downward due to an external shock given to the case 1.

Referring to FIGS. 8, 14-18, a method of making the antenna device 5 will be described. As shown in FIG. 8, the first electrode 18 (defined by a helical slit 18*a*) with the first terminal device 25 is stamped out from a conductive (for example, copper) foil sheet approximately 0.2 mm. Then the first terminal device 25 is bent so as to take the form of substantially an L.

Figure 14:
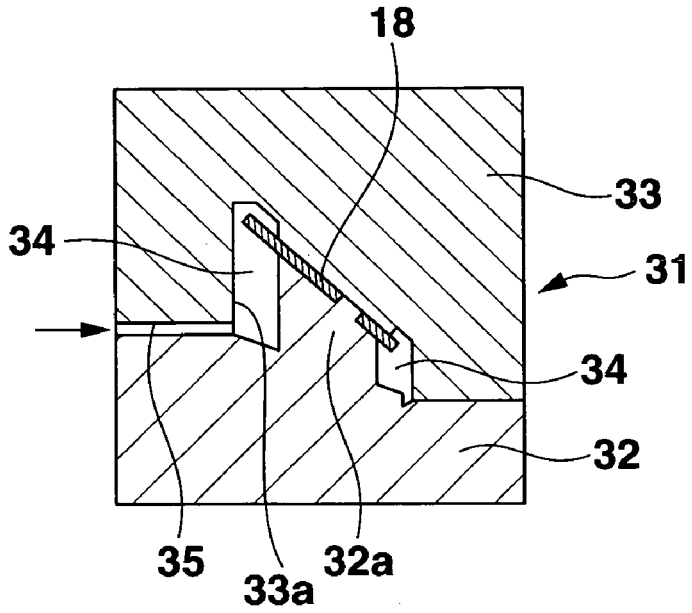
FIG. 14 is a cross-sectional view of a mold in which the first electrode of FIG. 8 is disposed.
Figure 15A:
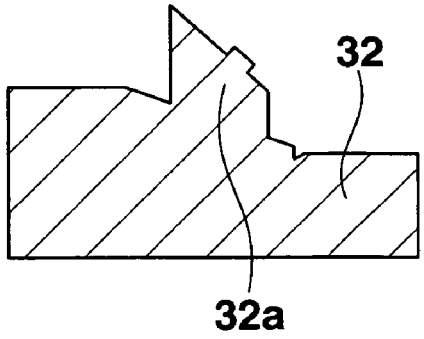
FIGS. 15A and 15B are cross-sectional views, respectively, of a lower mold half and the lower mold half of the mold of FIG. 14 on which the first electrode is disposed.
Figure 15B:
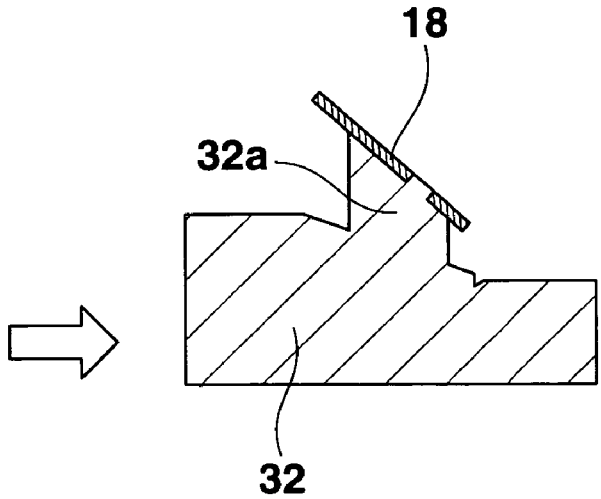

Then as shown in FIG. 14, the first bent electrode 18 is disposed at a predetermined position within a metal mold 31. More particularly, as shown in FIGS. 15A and 15B, the first electrode 18 is disposed on a projection 32*a* formed on an upper surface of a lower mold part 32 and corresponding in shape to the inner surface shape of the holder 17. Then, as shown in FIG. 14 an upper mold part 33 with a concavity 33*a* corresponding in shape to the outer surface of the holder 17 is superposed in position on the lower mold part 32 such that the first electrode 18 is placed between the projection 32*a* of the lower mold part 32 and the concavity 33*a* of the upper mold part 33. Then, the upper and lower molds 32 and the first electrode 18 are fixed together including the first electrode 18.

As shown in FIG. 14, in this state a cavity 34 corresponding in shape to the holder 17 is formed between the upper and lower mold parts 33 and 32. The first terminal device 25 (not shown) is disposed within the cavity 34. A gate 35 is provided between the upper and lower mold parts 33 and 32 through which resin should be injected into between the upper and lower mold parts 33 and 32. When the resin is injected through the gate 35 into the cavity 34, the holder 17 with its inner space or cavity 20 is formed with the first electrode 18 fixed to the upper end 17*a* of the holder 17.

Figure 16:
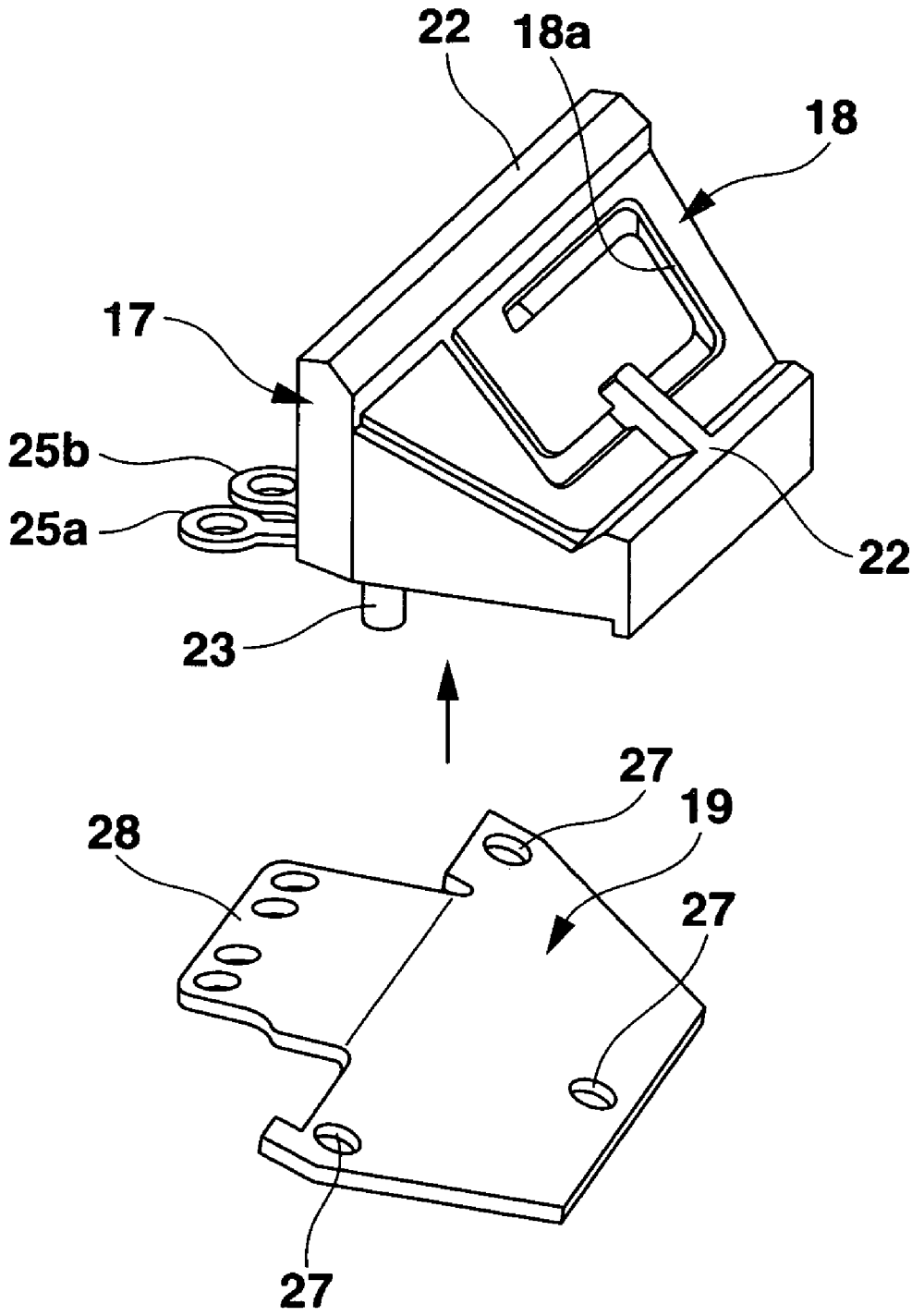
FIG. 16 illustrates in a perspective view a process for attaching the second electrode to the lower end of the holder molded in the method of FIG. 14.
Figure 17A:
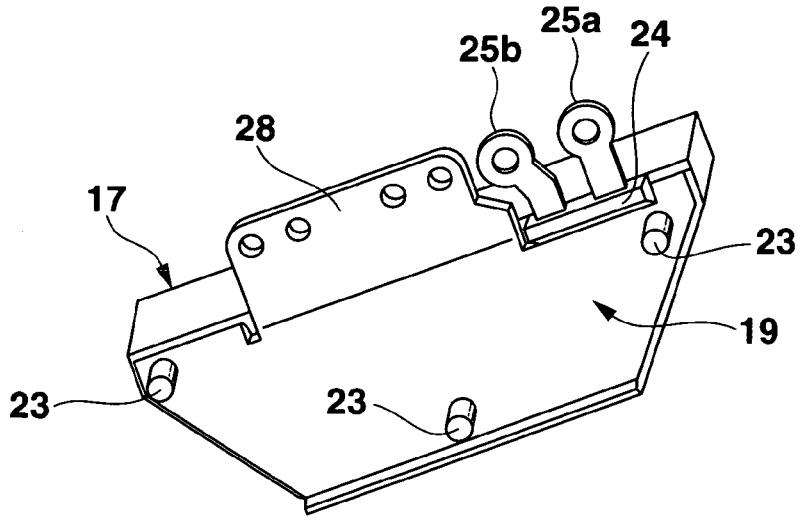
FIGS. 17A and 17B illustrate in a perspective view that fusible bosses of the holder are inserted into holes in the second electrode and that the fusible bosses are fused such that the second electrode is fixed to the holder of FIG. 17A, respectively.
Figure 17B:
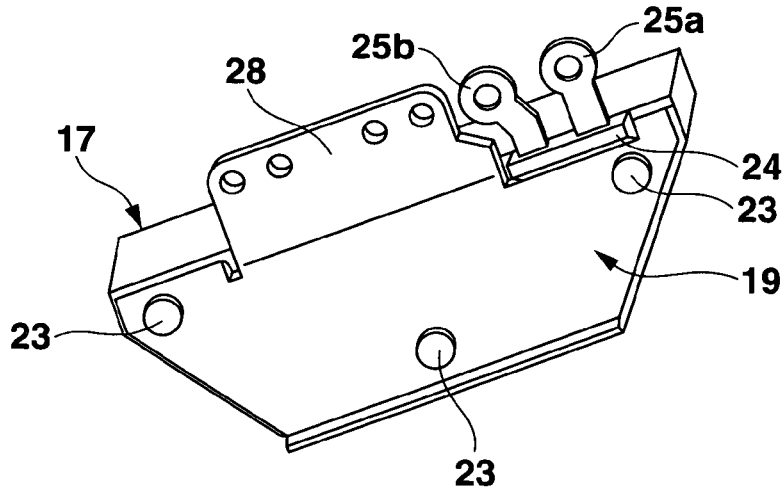

Then, the upper and lower mold parts 33 and 32 are separated and the holder 17 with the first electrode 18 attached thereto is taken out, as shown in FIG. 16. Then, the second electrode 19, which may be a stamped-out approximately 0.2 mm thick copper foil one, is attached fixedly to the lower end of the holder 17 so as to be opposite the first electrode 18 by inserting and melting the fusible bosses 23 provided on the lower end of the holder 17 into corresponding holes 27 in the second electrode 19, as shown in FIGS. 17A and 17B. This results in the antenna device 5 of FIGS. 3-6 with the first and second terminal devices 25 and 28 arranged side by side at the lower end of the back side of the holder 17.

Figure 18:
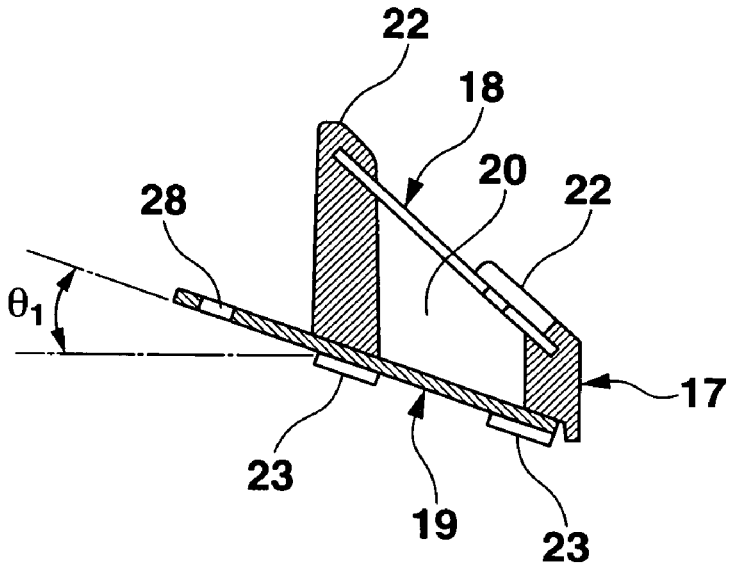
FIG. 18 is a cross-sectional view of the antenna device of FIG. 17B.

As shown in FIG. 18, the first and second terminal devices 25 and 28 extend backward (or leftward in FIG. 18) in the same plane as the lower end 17*b* of the holder 17. As shown in FIG. 6A, when the antenna device 5 is attached to the circuit board 14, the antenna device 5 is bent at the predetermined angle of θ1 to the horizontal and then disposed at a predetermined position in the antenna reception space 16 in the cantilevered manner within the case 1 such that the first electrode 18 disposed along the upper inclined end 17*a* of the holder 17 extends substantially parallel to the inner surface of the case 1, as shown in FIG. 2.

As described above, according to the antenna device 5 of the electronic wristwatch, the first helical electrode 18 with the first terminal device 25 is provided on the upper end of the cavity 20 within the holder 17. The second plate-like electrode plate 19 with the second terminal device 28 is provided on the lower end of the holder 17 so as to be opposite the first electrode 18 at the predetermined interval from the first electrode 18. That is, the predetermined interval is obtained between the first and second electrodes 18 and 19, which allows radio waves with short wavelengths are allowed to be received effectively. Furthermore, the air space of the minimum dielectric constant is provided between the first and second electrodes 18 and 19 in the cavity 20 within the holder 17, thereby allowing the radio waves of short wavelengths to be received with high sensitivity.

The first electrode 18 takes the helical form. Thus, although an area that the first electrode 18 occupies is small, the overall length of the first helical electrode 18 is great. Accordingly, although the holder 17 is of a small size, the reception frequency is adjustable. Furthermore, it is capable of receiving radio waves of short wavelengths securely, for example, from artificial satellites with high sensitivity. Thus, the antenna device can be used effectively as a GPS antenna for specifying where the user is. Furthermore, this antenna device is easy to manufacture, small in weight and can receive radio waves of a short wavelength with high sensitivity compared to the conventional antenna devices with the core around which the coil is formed.

The first electrode 18 is provided inclined on the upper end 17*a* of the holder 17 relative to its lower end 17*b*. Thus, the area where the first electrode 18 is provided is large, thereby improving the receiving sensitivity of the radio waves. In addition, especially when the antenna device is disposed within the case 1, the first electrode 18 provided on the upper end of the holder 17 can be easily directed from inside the case 1 to outside the case 1, thereby improving the directivity and hence sensitivity of radio wave reception.

The support wall 21 provided at the center of the holder 17 supports the first and second electrodes 18 and 19 so as not to be uneven. Thus, although the first and second electrodes 18 and 19 are made of the easily deformable conductive (for example, copper) foil, they are fixed in a stabilized state to the holder 17, thereby preventing their possible deformation and ensuring stabilized reception of the radio waves.

As shown in FIG. 3, the upward protective projections 22*a*, 22*b* are provided composing the upper parts of the opposing higher and lower walls 17*c* and 17*d* of the holder 17 extending upward beyond the plane of the first electrode 18. Thus, even when the case 1 is given a shock externally, for example, in transportation, assembly and/or use, the protrusions 22 will stop or absorb the shock, thereby preventing the first electrode 18 from being deformed. Therefore, the antenna device ensures stabilized reception of the radio waves.

As shown in FIG. 17, the fusible bosses 23 are provided on the lower end 17*b* of the holder 17. Thus, by disposing the second electrode 19 on the lower end of the holder 17 so as to receive the fusible bosses 23 of the holder 17 in the holes in the second electrode 19 and then fusing the fusible bosses 23, the second electrode 19 is securely fixed to the holder 17, thereby supporting the second electrode 19 in a stabilized state and ensuring a stabilized reception performance.

As shown in FIGS. 3 and 4, the first and second terminal devices 25 and 28 of the first and second electrodes 18 and 19, respectively, are disposed side by side collectively at the lower rear end of the higher wall 17*c* of the holder 17. Thus, the first and second electrodes 18 and 19 are easy to connect electrically, thereby improving the efficiency of the connecting operation. In addition, as shown in FIG. 2, since the first and second terminal devices 25 and 28 are directly connected to the circuit board 14 of the timepiece module 4, the antenna device 5 is easily attached to the circuit board 14.

The antenna device 5 is disposed in the antenna reception space 16 of the small dielectric constant within and near the case 1 in the cantilevered manner. Thus, the antenna device 5 is placed within the antenna reception space of the minimum dielectric constant and the receiving accuracy of the antenna device 5 is improved. Furthermore, since the antenna device 5 is supported in the cantilevered state within the case 16, the antenna device is protected from external direct shocks, and hence exhibits high resistance to shocks.

As described above, the stop 30 is provided on the upper surface of the back cover 6 below the antenna device 5. Thus, when the case 1 is given a downward external shock and the antenna device 5 is moved downward, the antenna device 5 comes into contact with the stop 30, which then prevents the antenna device from moving down further. That is, the antenna device 5 is almost always maintained at predetermined height from the upper surface of the back cover 6, thereby maintaining stabilized reception performance.

Especially, the antenna device 5 is received in the antenna reception space 16 within and near the case 1 at 12 o'clock where the wristband attachment 2 is positioned. Thus, the antenna device 5 is sufficient to be spaced from the electronic and metal parts of the wristwatch that may influence the receiving performance of the antenna device. When a user views a time indication of the wristwatch worn on the user's wrist near his or her breast, the antenna device 5 is placed at a position within the case 1 remote from the user's breast. Thus, the antenna device 5 is not much influenced by the user's body and hence the antenna's receiving performance is improved compared to a case where the antenna device 5 is disposed within the case at 6 o'clock.

According to the method of making the antenna device 5, by forming the first helical electrode 18 with the first terminal device 25, disposing the first electrode 18 at a predetermined position within the mold 31 and then injecting the resin into the cavity 34 within the mold 31, the holder 17 with the inner cavity 20 is formed integral with the first electrode 18. Thus, when the holder 17 is formed, the first electrode 18 is fixed to the holder 17 as a unit. Therefore, although the first electrode 18 is made of the thin conductive (for example, copper) foil approximately 2 mm thick, it can be fixed securely and accurately to the holder 17.

The mold 31 is separated and the holder 17 integral with the first electrode 18 is taken out, and the second electrode 19 with the second terminal 28 is then fixed to the lower end of the holder 17 so as to be opposite the first electrode 18. Thus, compared to the conventional antenna device with the core around which the coil is formed, the inventive antenna device is easy to manufacture, thereby improving productivity. Furthermore, since the predetermined interval is ensured between the first and second electrodes 18 and 19, reception of the radio waves of short wavelengths is achieved with high sensitivity.

Embodiment 2

Figure 19:
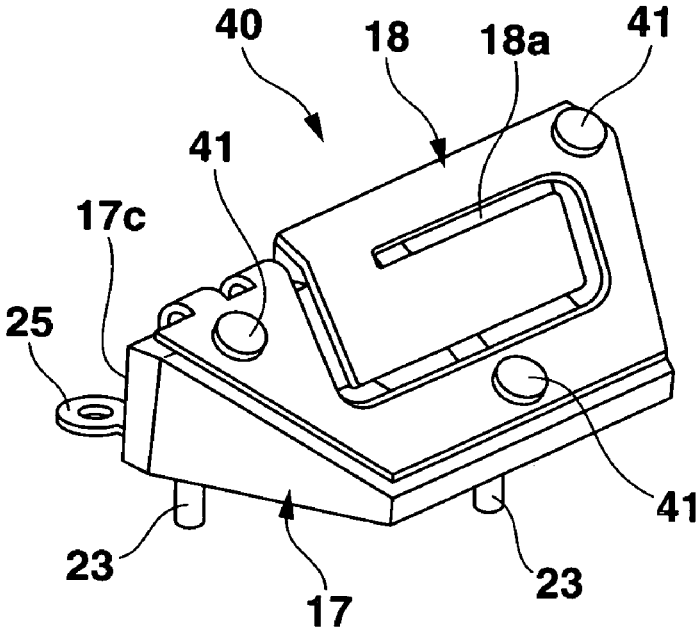
FIG. 19 is an enlarged perspective view of an embodiment 2 of the antenna device.
Figure 20:
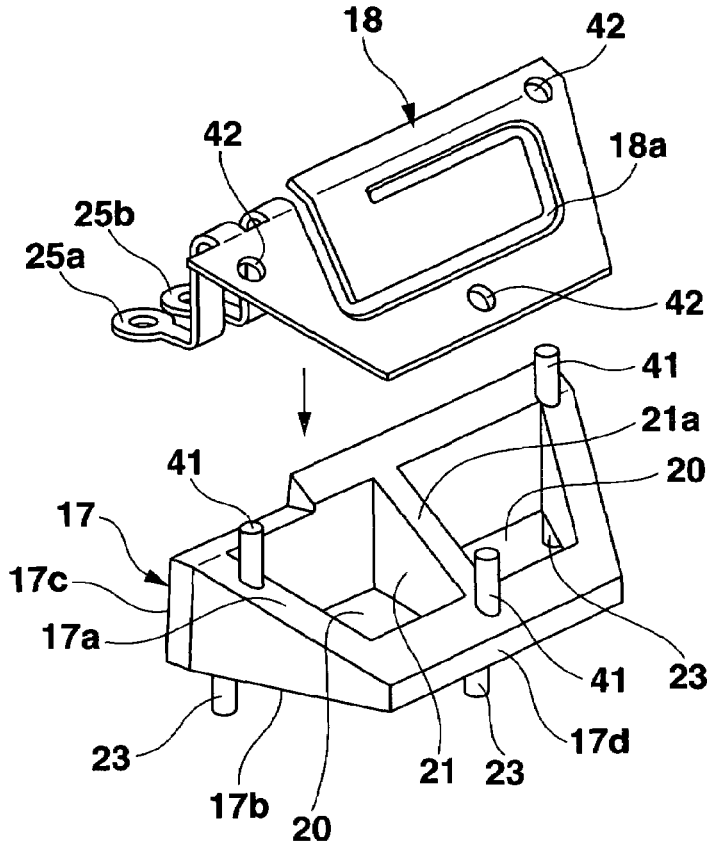
FIG. 20 illustrates attaching the first electrode to the holder of FIG. 19 in an exploded perspective view.
Figure 21:
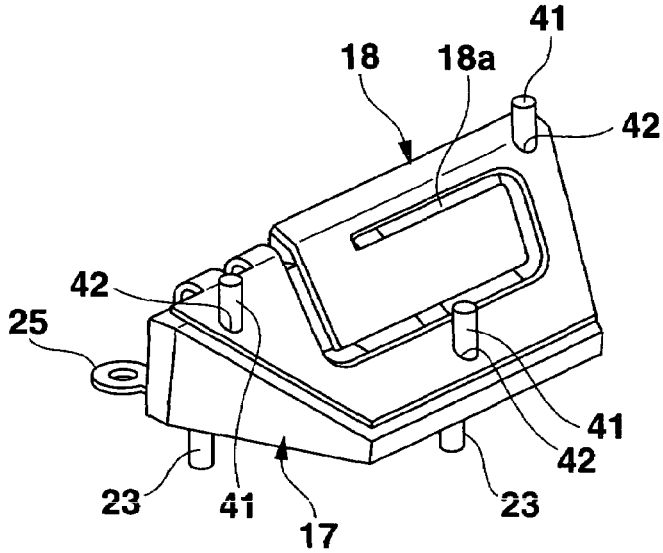
FIG. 21 shows the first electrode fitted over fusible bosses provided on the holder of FIG. 20.

Referring to FIGS. 19-21, the embodiment 2 of the antenna device according to the present invention applied to an electronic wristwatch will be described. As shown in FIG. 19, the antenna device 40 of the second embodiment is substantially the same in structure as that of the first embodiment 1 except that the first electrode 18 is fixed to the upper end of the holder 17 by means of its fusible bosses 41.

More particularly, as shown in FIG. 20, fusible bosses 41 are provided at predetermined positions on the upper end 17*a* of the holder 17, or more particularly, near the upper opposite ends of the rear or higher wall 17*c* of the holder 17 and at a midpoint on the front or lower wall 17*d* of the holder 17. The first electrode 18 has therein holes 42 at predetermined positions into which the fusible bosses 41 of the holder 17 are inserted. A first L-shaped terminal device 25 is provided at a rear left end of the first electrode 18 as viewed in FIG. 20. The terminal device 25 also comprises antenna and ground terminals 25*a* and 25*b* similar to those of the first embodiment 1.

As shown in FIGS. 20 and 21, in attachment the first electrode 18 is disposed on the upper end 17*a* of the holder 17 such that the fusible bosses 41 of the holder 17 are inserted into the respective holes 42 in the first electrode 18, and then melted, thereby fixing the first electrode 18 to the holder 17, as shown in FIG. 19. In this case, the first terminal device 25 of the first electrode 18 extends downward along the upper left rear end of the holder 17 and then extends in a bent state backward from the higher wall 17*c* of the holder 17, as in the embodiment 1.

Also in this antenna device 40, the first electrode 18 is fixed securely and strongly to the upper surface of the holder 17 by the fused bosses 41. Thus, the first electrode 18 is maintained in a stabilized reception state, thereby ensuring stabilized reception performance as in the first embodiment. Also in this case, the first terminal unit 25 is disposed so as to extend backward side by side along with the second terminal device 28 of the second electrode 19 attached to the lower end 17*b* of the holder 17. Thus, the first and second terminal devices 25 and 28 are directly connected electrically to the circuit board 14 of the timepiece module 4.

Embodiment 3

Figure 22:
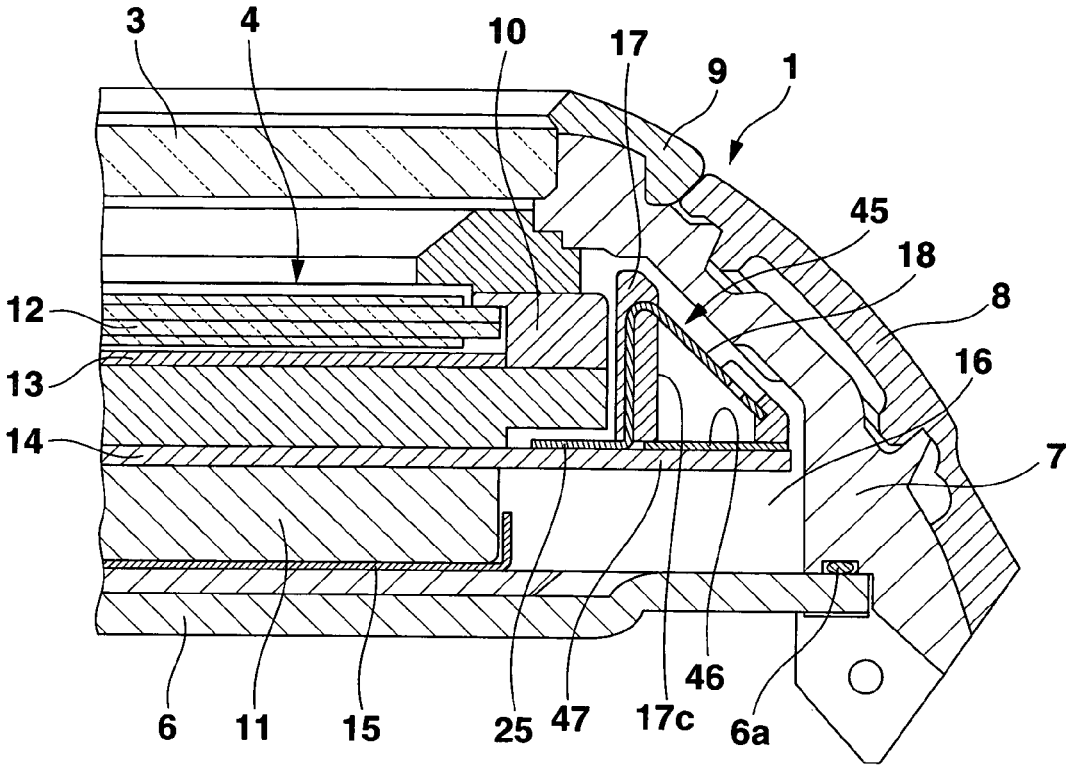
FIG. 22 is an enlarged cross-sectional view of an essential portion of an embodiment 3 of the antenna device according to the present invention applied to an electronic wristwatch.
Figure 23:
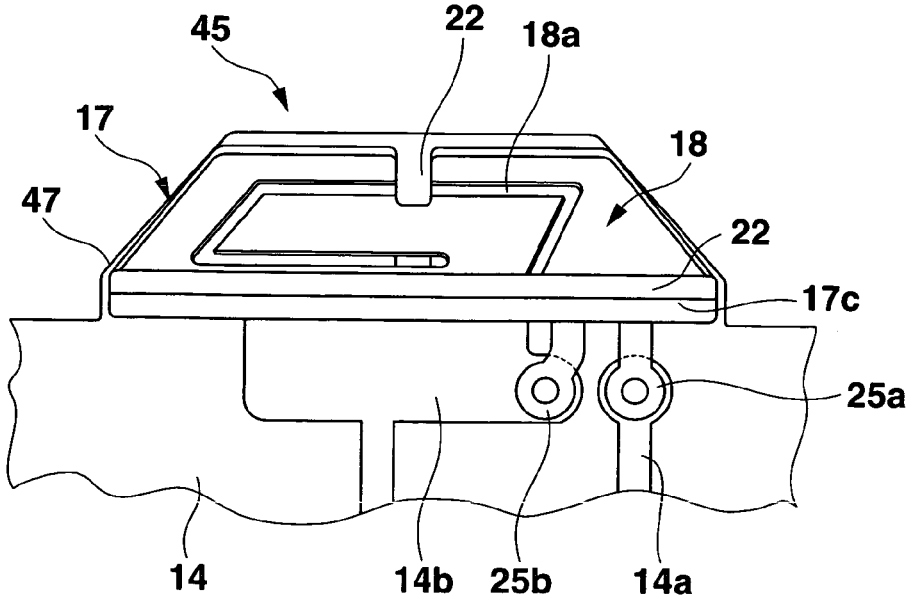
FIG. 23 is an enlarged plan view of the antenna device of FIG. 22 connected to a circuit board.

Referring to FIGS. 22 and 23, the third embodiment 3 of the antenna device according to the present invention applied to an electronic wristwatch will be described. As shown in FIG. 22, the antenna device 45 is substantially the same in structure as the embodiment 1 excluding that the second electrode 46 is provided on the circuit board 14 of the timepiece module 4 with a holder 17 provided on the second electrode.

As shown in FIG. 22, the circuit board 14 extends from the timepiece module 4 rightward into the antenna reception space 47 within the case 1 at 12 o'clock and supports the antenna device 45 on an end portion 47 thereof. In this antenna device 45, the second electrode 46 is formed as a pattern, for example, of a conductive (for example, copper) foil on the end portion 47 of the circuit board 14. Furthermore, the holder 17 is fixed in position on the second electrode 46.

The holder 17 is similar in structure to that of the embodiment 1. The first electrode 18 is provided on the upper end 17*a* of the holder 17. Also in this case, the first terminal device 25 of the first electrode 18 extends down through the higher or rear wall 17*c* of the holder 17 and is bent at the lower end 17*b* of the holder 17, and then electrically connected to the terminals 14*a* and 14*b* of the circuit board 14, for example, by soldering, as shown in FIG. 23. Thus, the fixing and connecting operations are easily performed.

This antenna device 45 of the electronic wristwatch produces advantages similar to those produced by the embodiment 1. In addition, since the second electrode 46 is provided on the end 47 of the circuit board 14, the second electrode need not be provided as a separate member. It may be formed simultaneously along with a wiring pattern of the circuit board 14. In addition, the holder 17 on which the first electrode 18 is provided is fixed at a position on the second electrode 36 provided on the end portion 47 of the circuit board 14 where the first electrode 18 is opposite to the second electrode 46. The first terminal device 25 of the first electrode 18 is fixed, for example by soldering, to the connection terminal 14*a* on the circuit board 14. Thus, the fixing and connecting operations are easily achieved.

Figure 24:
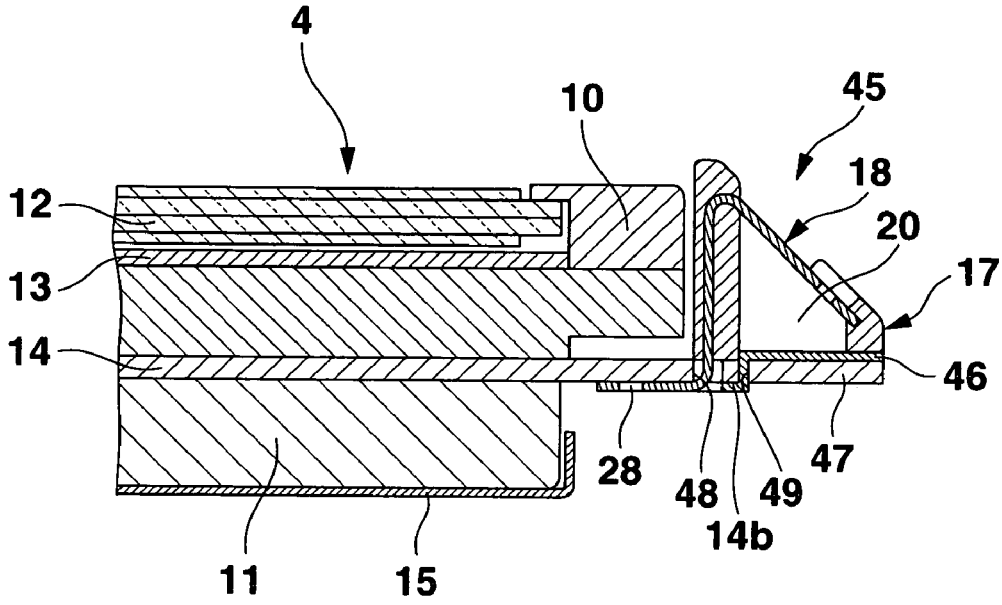
FIG. 24 is a cross-sectional view of an essential portion of an electronic wristwatch to which a modification of the embodiment 13 of the antenna according to the present invention is attached.
Figure 25:
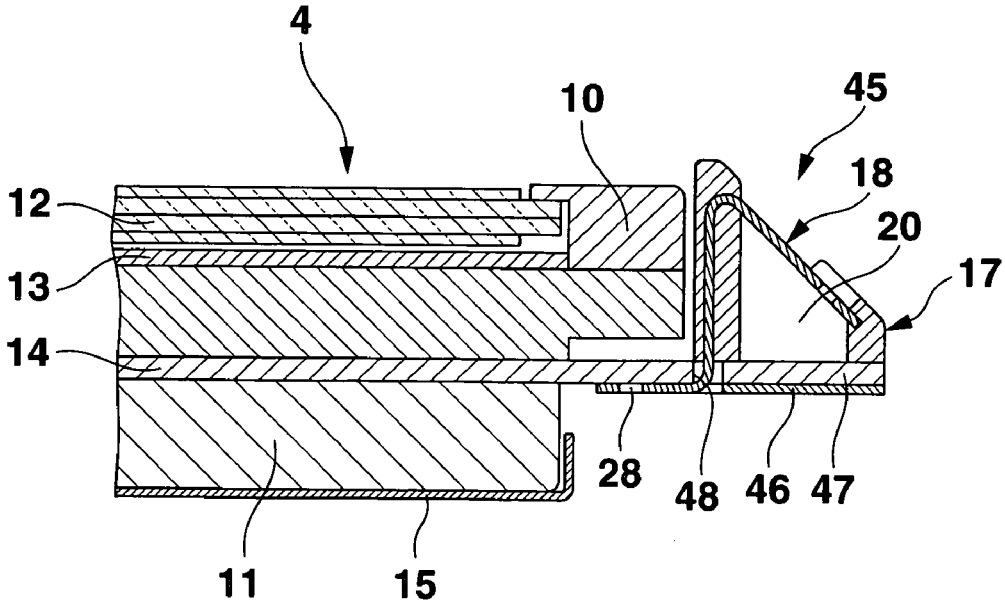
FIG. 25 is a view of a second modification of the embodiment 3 similar to FIG. 24.

While in the embodiment 3 the first terminal device 25 of the first electrode 18 is illustrated as disposed on the circuit board 14, the first terminal 25 of the first electrode 18 may be fixed to the lower surface of the circuit board 14 as shown in a first or second modification of FIG. 24 or 25.

In the first modification of FIG. 24, the end portion 47 of the circuit board 14 has a hole 48 through which the first terminal device 25 extends downward from the circuit board 14. The second electrode plate 46 is provided on the upper surface of the end portion 47 of the circuit board 14 with terminals 14*a* and 14*b* provided on the lower surface of the circuit board 14 as in FIG. 23. Thus, the first terminal device 25 is connected, by soldering, to the terminals 14*a* and 14*b*. The second terminal device (not shown) of the second electrode plate 46 extends downward through the hole 49 in the circuit board 14 from the upper surface of the circuit board 14 and is connected to the terminal 14*b*, by soldering, on the lower surface of the circuit board 14. This modification produces advantages similar to those produced by the embodiment 3.

In the second modification of FIG. 25, the second electrode plate 46 is formed as a pattern on the lower surface of the end portion 47 of the circuit board 14. The holder 17 is fixed to the upper surface of the end portion 47 opposite to the second electrode plate 46. The first terminal device 25 of the first electrode plate 18 provided on the upper end 17*a* of the holder 17 is connected, by soldering, to the terminals 14*a* and 14*b* provided on the lower surface of the circuit board 14 through the hole 48 in the end portion 47 as in FIG. 23 as in the first modification. Also, this modification produces advantageous effects similar to those produced by the embodiment 3.

Embodiment 4

Referring to FIGS. 26-31, the embodiment 4 of the antenna device according to the present invention applied to the an electronic wristwatch will be described.

Figure 28:
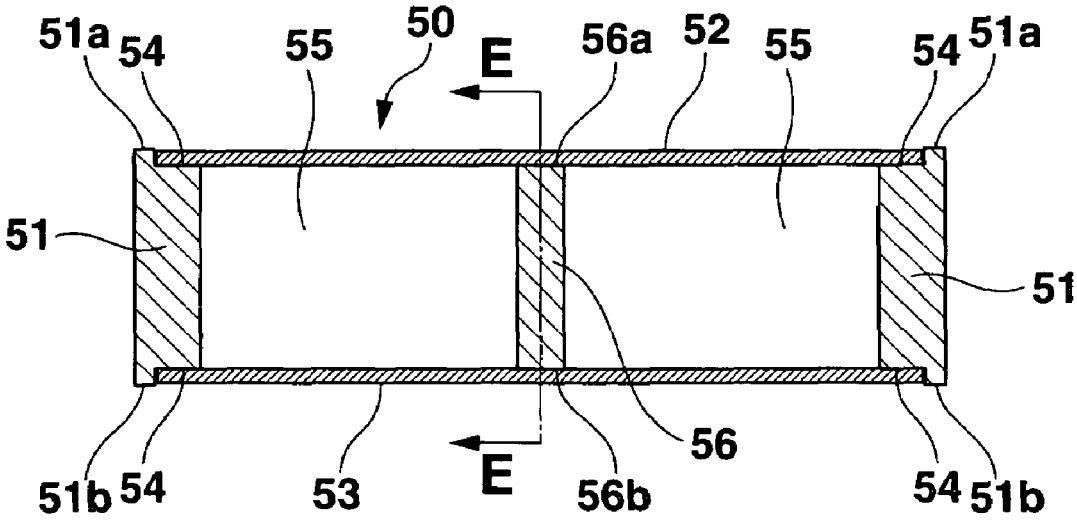
FIG. 28 is a cross-sectional view taken along a line XXVIII-XXVIII of FIG. 27.
Figure 29:
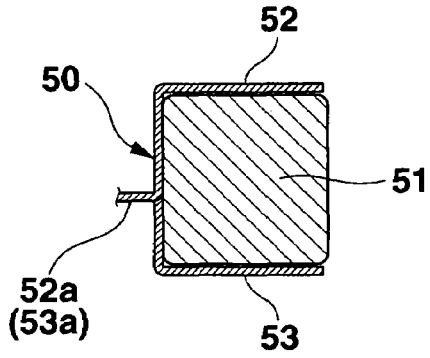
FIG. 29 is a cross-sectional view taken along a line XXIV-XXIX of FIG. 28.
Figure 30:
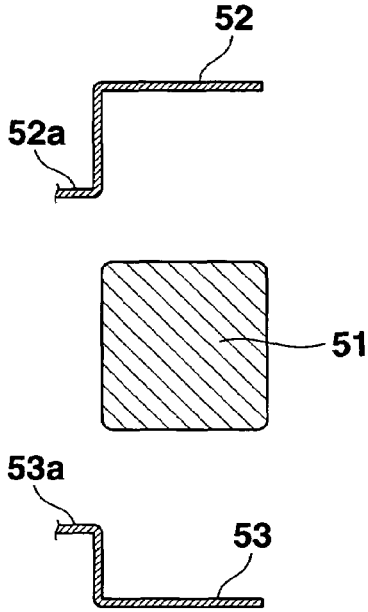
FIG. 30 is an exploded view of the antenna device of FIG. 29.

The antenna device 50 is similar in structure to that of the embodiment 1 excluding that as shown in FIGS. 26-31 the antenna device 50 of this embodiment comprises a rectangular box-like holder 51 of a dielectric material such as ABS, and first and second thin conductive electrode plates or foils 52 and 53 fitted and fixed to the upper and lower ends, respectively, of the holder 51 at step-like cutouts 54 formed on the inner edges of upper and lower ends 51*a* and 51*b* of the holder, as shown in FIG. 28. The upper surface of the first electrode 52 is flush with the upper end of the holder 51 and the lower surface of the second electrode 52 is flush with the lower end of the holder 51.

As shown in FIG. 28, a support wall 56 is provided at the center of the hollow holder 51 so as to support the first and second electrodes plates 52 and 53 from below and above in a flat state without becoming uneven.

Figure 26:
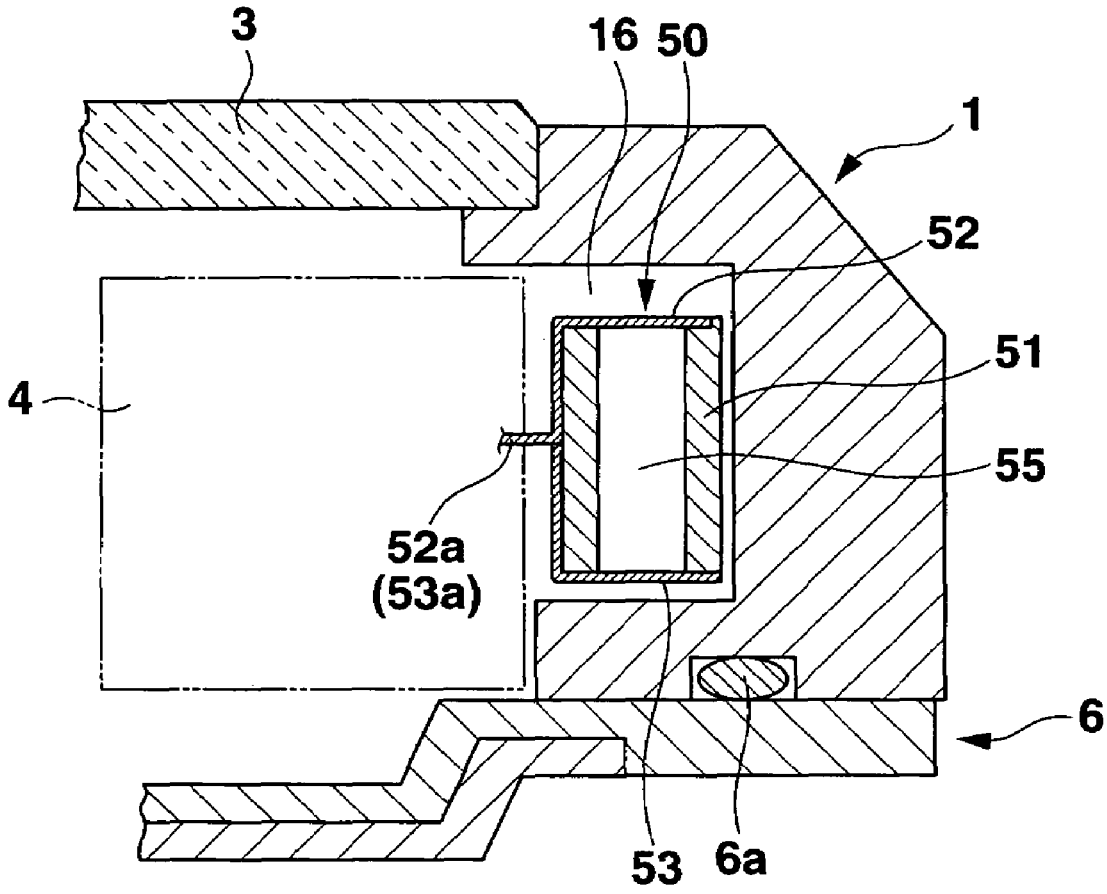
FIG. 26 is an enlarged cross-sectional view of an essential portion of an electronic wristwatch to which an embodiment 4 of the antenna device according to the present invention is applied.
Figure 27:
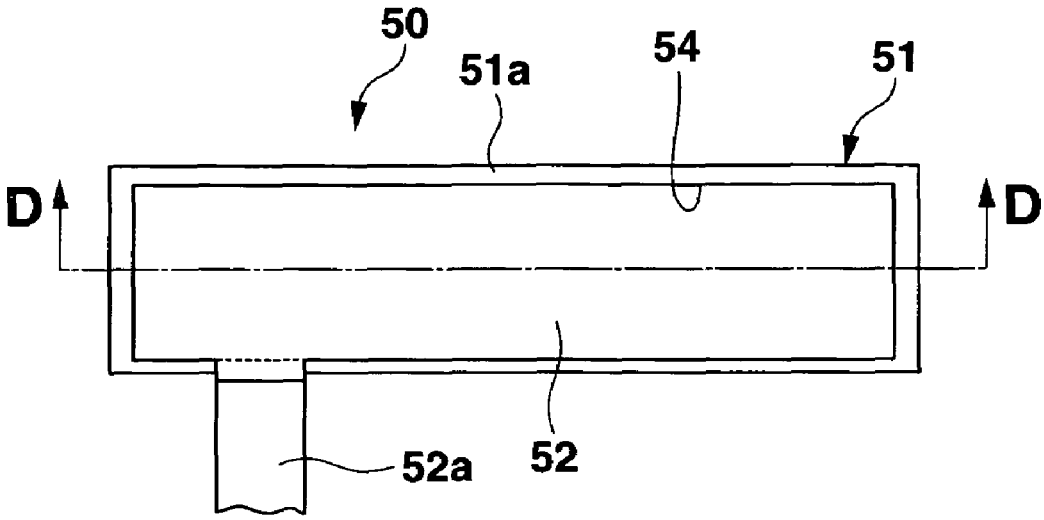
FIG. 27 is an enlarged plan view of the antenna device of FIG. 26.
Figure 31:
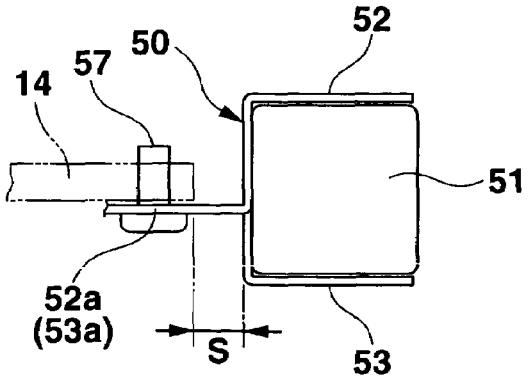
FIG. 31 shows the antenna device of FIG. 29 attached by screws to a circuit board.

As shown in FIGS. 26 and 31, the first and second terminal devices 52*a* and 53*a* of the first and second electrode plates 52 and 53, respectively, extend leftward from the left side of the holder 51 and are connected electrically by screws 57 to the circuit board 14. Thus, as shown in FIG. 31, the antenna device 50 is positioned at a distance S from the circuit board 14 and the first and second terminals 52*a* and 53*a* are fixed by screws 57 to the circuit board 14 such that the circuit board 14 does not influence the reception performance of the antenna device 50. The antenna device 50 need not be fixed to the circuit board 14, but may be fixed to the case 1.

The antenna device 50 of this embodiment comprises the rectangular box-like holder 51 of a dielectric material and the first and second thin electrodes 52 and 53 disposed on the upper and lower ends 51*a* and 51*b*, respectively, of the holder 51, thereby providing a compact structure. In addition, the first and second electrodes 52 and 53 are fixed to the upper and lower ends of the holder 51 which are spaced by the predetermined distance. Thus, the first and second electrodes 52 and 53 can cooperate to receive radio waves with a short wavelength, for example, coming from artificial satellites and also be used as GPS antenna device for specifying the user's position.

In this embodiment, the first and second electrodes 52 and 53 are fitted and fixed to the corresponding step-like cutouts 54 provided at the respective upper and lower inner edges of the holder 51. In this case, no adhesives or double-faced adhesives are used. Thus, the antenna device is easy to manufacture, small in weight and has high reception performance because it uses no adhesives or double-faced adhesives whose dielectric constant can age, compared to the conventional antenna device with the core around which the coil is formed.

The space between the first and second spaced electrodes 52 and 53 attached to the upper and lower ends of the cavity 20 in the holder is filled with air of a minimum dielectric constant. Thus, the reception performance of the antenna device is furthermore improved and the weight of the antenna is reduced. In addition, the support wall 56 provided at the center of the holder 51 ensures a sufficient strength of the hollow holder.

In this case, the support wall 56 is provided at the center of the hollow holder 51 such that the support wall 56 cooperates with the holder 51 to support the first and second electrodes 52 and 53 in a flat state. Thus, the support wall 56 supports the first and second electrodes 52 and 53 at their centers from below and above, respectively, so as to be in a stabilized state and then fixes the first and second electrodes 52 and 53 to the holder 51 securely. This prevents the first and second electrodes 52 and 53 from being deformed, thereby ensuring stabilized reception of radio waves.

The first and second electrodes 52 and 53 are fixed to the upper and lower ends 51*a* and 51*b*, respectively, of the holder 51. Thus, even somewhat nonstandard sizes of the first and second electrodes 52 and 53 that may occur due to manufacture are almost absorbed and/or deformations of the first and second electrodes occurring possibly in assembly are reduced. This serves to fix the first and second electrodes 52 and 53 to the upper and lower ends 51*a* and 51*b* of the holder 51 with high accuracy, thereby ensuring stabilized reception performance. Especially, the reception performance can be easily adjusted by replacing the holder 51 with another appropriate one of a different size, as required.

As shown in FIG. 31, the first and second electrodes 52 and 53 are fixed to the timepiece module 4 or the case 1 by screws 57 with the predetermined distance S between the inner side of the antenna device 50 and the adjacent end of the circuit board 14 such that the circuit board does not influence the reception performance of the antenna device 50. In this case, the antenna device 50 is fixed securely and well so as not to deviate from its reference position, thereby stabilizing the reception performance of the GPS antenna device.

The antenna device 50 is received in the antenna reception space 16 within the case 1 near its inner surface at 12 o'clock. Thus, the antenna device 50 is sufficient to be spaced from electronic and metal parts of the wristwatch that may influence the reception performance thereof. When the user views a time indication of the wristwatch worn on his or her wrist before his or her breast, the antenna device 50 is placed at a position within the case 1 remote from the user's breast. Thus, the antenna device 50 is difficult to receive influence of the user's body and hence the reception performance of the antenna device 50 is improved compared to the case in which the antenna device 50 is provided within the case 1 at 6 o'clock.

Embodiment 5

Figure 32:
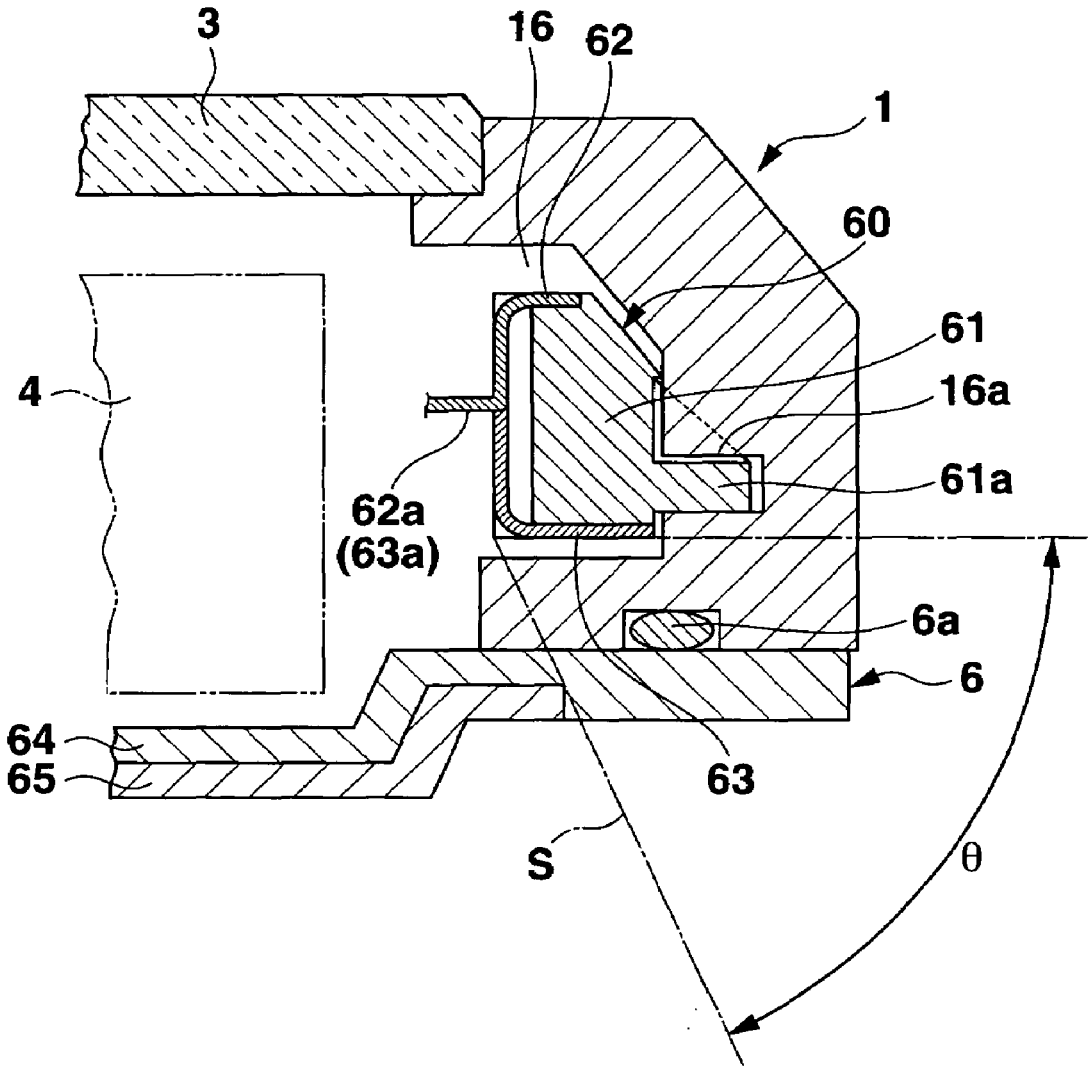
FIG. 32 is an enlarged cross-sectional view of an essential portion of a wristwatch to which an embodiment 5 of the antenna device according to the present invention is applied.
Figure 33:
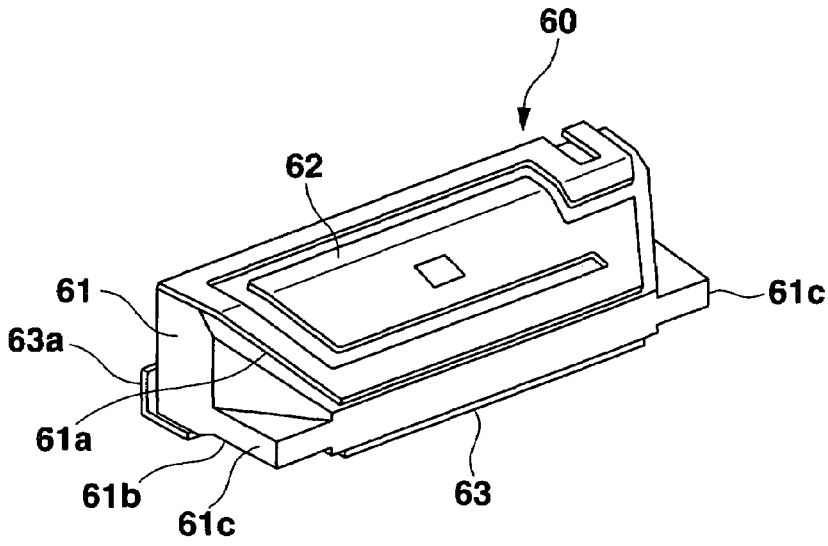
FIG. 33 is a perspective view of the antenna device of FIG. 32.

Referring to FIGS. 32 and 33, the embodiment 5 of the antenna device according to the present invention applied to an electronic wristwatch will be described.

The antenna device 60 of this embodiment is substantially the same as the embodiment 1 in that the antenna device 60 comprises a hollow holder 61 of a dielectric material such as ABS and having a horizontal trapezoidal cross section and first and second thin conductive (for example, copper) electrodes 62 and 63 attached to the upper and lower ends of the holder 61. The antenna device 60 is attached in the antenna reception space 16.

As shown in FIG. 33, the holder 61 has a preferably hollow body with its upper end 61*a* inclined to its lower end 61*b*. The holder 61 has a pair of triangular positioning protrusions 61*c* each on a respective one of both sides thereof inserted and fixed in a cavity 16*a* provided in the inner surface of the case 1

As shown in FIG. 33, the first and second electrodes 62 and 63 are spaced by a predetermined interval from each other and have first and second terminals 62*a* and 63*a*, respectively, with their end portions extending away from the holder 61 (or leftward in FIG. 32) and connected electrically to the timepiece module 4.

As shown in FIG. 32, the back cover 6 comprises a resin bottom 64 covering the whole lower end of the case 1 and a plate-like metal bottom 65 superposed on the resin bottom 64 and extending so as to fall short of a predetermined angular range below the antenna device 60. As shown in FIG. 32, the resin bottom 64 composes the inner (or upper) part of the back cover 6 and is pressed through a waterproof ring 6*a* against the lower end of the case 1 for waterproof purposes. To this end, the resin bottom 64 is preferably made of rigid plastic such as glass fiber reinforced plastic. The metal bottom 65 has a shielding function to prevent static charges produced on the user's body or arm from influencing the antenna device, and is molded integral with the plastic bottom 64.

As shown in FIG. 32, a straight line S connecting a lower inner point of the second electrode 63 and the upper outer point on the metal bottom 65 is inclined at an angle of θ greater than, or equal to, 30° to the horizontal bottom of the antenna device 60. Preferably, θ is in a range of 45-90°, and more preferably, approximately 60°. This serves to minimize radio-wave interference exerted by the metal bottom 65 disposed below the antenna device 60.

According to this arrangement, the antenna device 60 is placed within the antenna reception space 16 of the plastic case 1. Thus, the external radio waves coming into the case 1 from above and sideways can be received well as in the embodiment 1. In addition, the metal bottom 65 of the back cover 6 has such an extension that a nonmetallic space is ensured in an angular range of θ obliquely from below the antenna device 60. The antenna device 16 is capable of receiving radio waves coming obliquely from below the case 1 in an angular range of θ without being influenced by the metal bottom 65 of the back cover 6, thereby improving the reception accuracy thereof. Furthermore, since the antenna device 60 is disposed within the case 1 near its inner surface, the whole size of the wristwatch is reduced.

Since the plastic bottom 64 in contact with the lower end of the case 1 is made of rigid plastic such as glass fiber reinforced plastic, watertightness is improved by pressing the bottom 6 against the case 1 through the waterproof ring 6*a*. Since the metal bottom 65 is formed integral with the plastic bottom 64 in molding, the back cover 6 can be easily made. Thus, the number of parts to be used is not large and the assembling operation is not complicated. Thus, the resulting wristwatch is inexpensive.

In the antenna device 60, the plastic holder 61 with the first and second electrodes 62 and 63 thereon has the pair of positioning protrusions 61*a* inserted into the corresponding holes 16*a* provided on the inner surface of the case 1 and is fixedly supported by the case in the cantilevered manner. Thus, the antenna device 60 is in an air atmosphere having a minimum dielectric constant and hence has an improved reception accuracy. No external shocks are given directly to the antenna device 60 because the antenna 60 is supported in the cantilevered manner. That is, the antenna device 60 has high resistance to shocks.

Figure 34A:
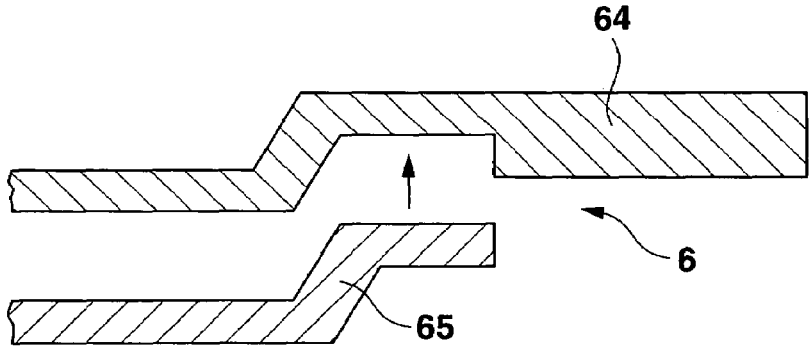
FIG. 34A is a cross-sectional view of essential parts of separated plastic and metal bottoms of a modification of the back cover of FIG. 32.
Figure 34B:
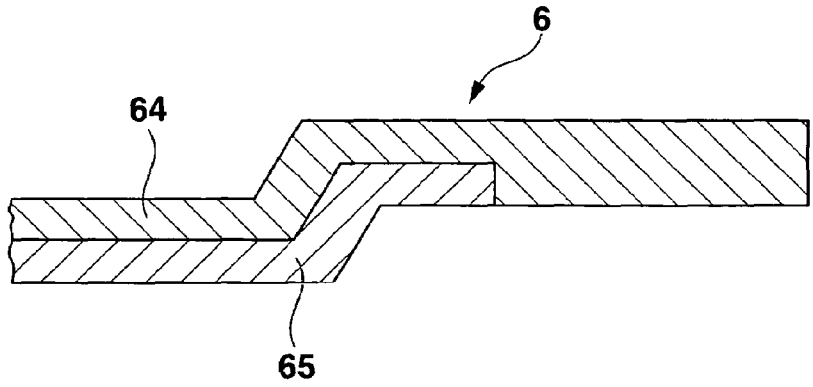
FIG. 34B is a cross-sectional view of essential parts of the fitted plastic and metal bottoms of the modification.

While in the embodiment 5 the metal bottom 65 of the back cover 6 is illustrated as formed integral with the plastic bottom 64 in molding, the back cover may be in another method. For example, as shown in modifications of FIGS. 34A and 34B, plastic and metal bottoms 64 and 65 of the back cover 6 may be formed separately and then fitted to each other so as to form a unit cover. In this case, these operations are not complicated and the resulting back cover becomes inexpensive.

While in the embodiments 1-5 the electronic wristwatches to which the antenna devices of the present invention are applied were illustrated, the antenna device of the present invention may be applied to various other watches such as travel watches, alarm clocks, general clocks, wall clocks as well as other various electronic devices such as mobile telephones and PDAs (Personal Digital Assistants).

Conclusions:

In a first aspect, as shown in FIGS. 1-34, an antenna device comprises: a hollow dielectric plastic holder (17, 51, 61) with a pair of opposite ends (17*a*, 61*a*, 61*a*; 17*b*, 51*b*, 61*b*) with the hollow inside of the holder open to the air through the pair of ends, a first helical electrode plate (18, 52, 62) attached to one of the pair of opposite ends, the first electrode plate having a first terminal device (25*a*, 52*a*, 62*a*); and a second flat electrode plate (19, 46, 53, 63) attached to the other of the pair of opposite ends so as to be opposite the first electrode plate, the second electrode having a second terminal device (28, 53*a*, 63*a*).

According to this aspect, the first helical electrode plate with first terminal device is attached to one of the pair of opposite ends, and the second flat electrode plate with the second terminal device is attached to the other of the pair of opposite ends so as to be opposite the first electrode plate. Thus, radio waves, for example, of a predetermined wavelength are receivable. Since the inside of the holder is hollow and open to the air, the space between the first and second electrode plates is filled with air having the minimum dielectric constant, thereby allowing radio waves of a short wavelength to be received with high sensitivity.

In a second aspect, as shown in FIGS. 1-25, 32, 33, the one of the pair of opposite ends is inclined relative to the other.

According to this aspect, since the one of the pair of opposite ends to which the first electrode plate is attached is inclined relative to the other of the pair of ends, an area of the first electrode plate is provided is large, thereby improving the reception sensitivity. In addition, especially when the first electrode plate attached to the inclined end of the holder of the antenna device incorporated in a portable electronic device such as a wristwatch can be easily directed toward outside the wristwatch. Thus, the directivity of radio-wave reception is improved.

In a third aspect, as shown in FIGS. 1-31, the antenna device further comprises a support wall (21, 56) provided at the center of the hollow holder (17, 51) for supporting the first and second electrode plates (18, 52, 62; 19, 46, 53, 63) from the inside of the hollow holder so as to maintain the first and second electrode plates flat.

According to this aspect, the support wall provided at the center of the hollow holder and supports the first and second electrode plates from the inside of the hollow holder so as to maintain the first and second electrode plates flat. Thus, although the first and second electrode plates are made of a thin conductive foil, for example, of copper, they are fixed to the holder in a stabilized state, thereby ensuring stabilized reception performance. Although especially the first electrode plate is in the helical form and liable to be deformed, the first helical electrode plate is supported at its center from below. Thus, the first electrode plate is prevented from being deformed and fixed surely to the holder in a stabilized manner.

In a fourth aspect, as shown in FIGS. 1-25, the antenna device further comprises a pair of outward protrusions (22*a*, 22*b*) provided at the one (17*a*) of the pair of ends of the holder (17, 51) such that each of the protrusions protrudes from a respective one of both opposite sides of the first electrode plate for protecting the first electrode plate.

According to the fourth aspect, a pair of outward protrusions (22*a*, 22*b*) are provided at the one (17*a*) of the pair of ends of the holder (17, 51) such that each of the protrusions protrudes from a respective one of both opposite sides of the first electrode plate for protecting the first electrode plate. Thus, even if the wristwatch gets an external shock in transportation, assembly and use, the protrusions stop the shock, thereby preventing the first electrode plate from being deformed and ensuring a stabilized reception performance.

In a fifth aspect, as shown in FIGS. 1-21, at least the second electrode plate (19) is fused to the other (17*b*) of the pair of ends of the holder by fusible bosses (23).

According to this aspect, at least the second electrode plate is fused to the other of the pair of ends of the holder. Thus, the second electrode plate is surely and strongly fixed to the other end of the holder, thereby maintaining the second electrode plate in a stabilized reception state and hence ensuring reception performance.

In a sixth aspect, as shown in FIGS. 1-21, the first and second terminal devices (25, 28) of the first and second electrode plates (18, 19), respectively, are disposed side by side on a side of the other (17*b*) of the holder.

According to this aspect, the first and second terminal devices of the first and second electrode plates, respectively, are disposed side by side on a side of the other of the holder. That is, the first and second terminal devices are collectively arranged. This causes the first and second terminal devices to be easily connected electrically, thereby improving the connection efficiency. The first and second terminal devices can be attached directly to a circuit board and hence the antenna device can be easily attached to the circuit board.

In a seventh aspect, as shown in FIGS. 1-17, an antenna device comprises a dielectric plastic holder (17) with an upper end (17*a*) and a lower end (17*b*); a first electrode plate (18) with a first terminal device (25) attached to the upper surface of the holder so as to be opposite the first electrode plate, and a second electrode plate (19) with a second terminal device (28) attached to the lower surface of the holder; the first and second terminal devices being disposed side by side at a side of the holder and having end portions connected to a circuit board (14).

According to this aspect, the first electrode plate with a first terminal device is attached to the upper surface of the holder, and the second electrode plate with a second terminal device is attached to the lower surface of the holder so as to be opposite to the first electrode plate. Thus, the first and second terminal devices are placed at a predetermined interval by the holder, thereby allowing radio waves of a short wavelength, for example from artificial satellites, to be securely received with high sensitivity. Therefore, the antenna device is suitable for use as a GPS one for locating where a user is. Furthermore, the first and second terminal devices are arranged side by side at a side of the holder and having end portions connected to the circuit board. Thus, the first and second terminal devices can be directly connected electrically, thereby making the attaching and connecting operations easy. The first and second terminal devices can be bent at a predetermined angle to adjust a position where the holder is set and the direction of the first electrode plate attached to the upper end of the holder. Thus, the antenna device can be installed in an optimal reception state, thereby ensuring reception sensitivity.

In an eighth aspect, as shown in FIGS. 1-17, the antenna device further comprises a stop (30) provided below and close to the lower end of the holder (17) for preventing a downward movement of the antenna device beyond a level of the stop.

According to this aspect, the stop is provided below and close to the lower end of the holder. Thus, even when the holder may move downward from its normal position, the stop stops further movement of the holder beyond the level of the stop. This causes the holder and the first electrode plate to be disposed always at predetermined positions, thereby ensuring stabilized reception sensitivity.

In a ninth aspect, as shown in FIGS. 14-18, a method of making an antenna device comprises the steps of forming a first helical electrode plate (18) with a first terminal device (25); disposing the first electrode plate with the first terminal device at a predetermined position in a mold (31); injecting a dielectric resin into the mold, thereby forming a hollow holder (17) integral with the first electrode; taking out the hollow holder integral with the first electrode from the mold; and fixing a second electrode plate (19) with a second terminal device (28) to the taken out holder so as to be opposite to the first electrode plate.

According to this aspect, after forming the first helical electrode plate with the first terminal device, the first electrode plate with the first terminal device is disposed at the predetermined position in the mold. Then, a dielectric resin is injected into the mold, thereby forming a hollow holder fixed integral with the first electrode. Thus, when the holder is made, the first electrode plate is formed integral with the holder. Hence although the first electrode plate is made of a thin metal plate, for example, of a copper foil, the first electrode plate is fixed to the holder securely and strongly. Then the hollow holder integral with the first electrode is taken from the mold, and the second electrode plate with a second terminal device is fixed to the taken out holder so as to be opposite to the first electrode plate. Thus, the antenna is easy to make, improved in productivity and capable of receiving radio waves of a short wavelength with high sensitivity compared to antenna devices with a core around which the coil is formed.

While in the embodiments 1-5 the electronic wristwatches to which the antenna devices of the present invention are applied were illustrated, the antenna device of the present invention may be applied to various other watches such as travel watches, alarm clocks, general clocks, wall clocks as well as other various electronic devices such as mobile telephones and PDAs (Personal Digital Assistants).

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Applications No. 2005-101656 and 2005-101657 filed on Mar. 31, 2005, and each including specification, claims, drawings and summary. The disclosure of the above Japanese patent application is incorporated herein by reference in its entirety.

What is claimed is:

1. An antenna device comprising:

a hollow dielectric plastic holder having a pair of opposite ends and a hollow inside that is open to outside the holder through the pair of opposite ends;

a first helical electrode plate which is attached to a first one of the pair of opposite ends, and which has a first terminal device;

a second flat electrode plate which is attached to a second one of the pair of opposite ends so as to be opposite the first electrode plate, and which has a second terminal device; and a support wall provided at a center of the hollow holder to support the first and second electrode plates from the inside of the hollow holder so as to keep the first and second electrode plates flat.

2. The antenna device of claim 1, wherein the first one of the pair of opposite ends is inclined relative to the second one of the pair of opposite ends.

3. An antenna device, comprising:

a hollow dielectric plastic holder having a pair of opposite ends and a hollow inside that is open to outside the holder through the pair of opposite ends;

a first helical electrode plate which is attached to a first one of the pair of opposite ends, and which has a first terminal device;

a second flat electrode plate which is attached to a second one of the pair of opposite ends so as to be opposite the first electrode plate, and which has a second terminal device; and outward protrusions provided at the first one of the pair of opposite ends to protect the first electrode plate, wherein each of the outward protrusions protrudes from a respective one of two opposite sides of the first electrode plate to protect the first electrode plate.

4. An antenna device, comprising:

a hollow dielectric plastic holder having a pair of opposite ends and a hollow inside that is open to outside the holder through the pair of opposite ends;

a first helical electrode plate which is attached to a first one of the pair of opposite ends, and which has a first terminal device; and a second flat electrode plate which is attached to a second one of the pair of opposite ends so as to be opposite the first electrode plate, and which has a second terminal device;

wherein fusible bosses are provided at least on the second one of the pair of opposite ends, and the second electrode plate is fused to the second one of the pair of opposite ends by the fusible bosses provided on the second end of the pair of opposite ends of the holder.

5. An antenna device, comprising:

a dielectric plastic holder with an upper surface and a lower surface;

a first electrode plate which has a a first terminal device and which is attached to the upper surface of the holder; and a second electrode plate which has a second terminal device and which is attached to the lower surface of the holder so as to be opposite the first electrode plate;

wherein the first and second terminal devices are disposed side by side at a side of the holder and have end portions connected to a circuit board; and wherein a stop is provided below and close to a lower end of the holder to prevent downward movement of the antenna device beyond a level of the stop.

* * * * *